US006568084B2

(12) United States Patent
McCool et al.

(10) Patent No.: US 6,568,084 B2
(45) Date of Patent: May 27, 2003

(54) RAZOR BLADE CARTRIDGE WITH GUARD RIBS

(75) Inventors: Gregory F. McCool, Staunton, VA (US); Jeffrey W. Wonderley, Fort Defiance, VA (US)

(73) Assignee: American Safety Razor Company, Verona, VA (US)

( * ) Notice: Subject to any disclaimer, the term of this patent is extended or adjusted under 35 U.S.C. 154(b) by 0 days.

(21) Appl. No.: 09/885,545

(22) Filed: Jun. 21, 2001

(65) Prior Publication Data

US 2002/0046465 A1 Apr. 25, 2002

Related U.S. Application Data

(63) Continuation-in-part of application No. 09/161,422, filed on Sep. 24, 1998, now Pat. No. 6,378,211.

(60) Provisional application No. 60/081,589, filed on Apr. 14, 1998, provisional application No. 60/082,261, filed on Apr. 17, 1998, and provisional application No. 60/212,842, filed on Jun. 21, 2000.

(51) Int. Cl.[7] ..... B26B 21/16

(52) U.S. Cl. ..... 30/50; 30/77; 30/84

(58) Field of Search ..... 30/32, 34.2, 47, 30/50, 77, 81, 84

(56) References Cited

U.S. PATENT DOCUMENTS 4,146,958 A * 4/1979 Chen et al. ..... 30/50
4,247,982 A * 2/1981 Booth et al. ..... 30/41
4,272,885 A * 6/1981 Farraro ..... 30/50
4,461,079 A * 7/1984 Ciaffone et al. ..... 50/50
4,535,537 A * 8/1985 Ferraro et al. ..... 30/50
4,641,429 A * 2/1987 Abatemarco ..... 30/50
4,914,817 A * 4/1990 Galligan et al. ..... 30/77
5,359,774 A * 11/1994 Althaus ..... 30/50
5,575,068 A * 11/1996 Pedersen ..... 30/47
6,216,349 B1 * 4/2001 Gilder et al. ..... 30/50
6,378,211 B1 * 4/2002 McCool et al. ..... 30/50

* cited by examiner

*Primary Examiner*—Hwei-Siu Payer
(74) *Attorney, Agent, or Firm*—McDermott, Will & Emery

(57) ABSTRACT

A razor blade cartridge is disclosed for wet shaving. The razor blade cartridge includes a platform member having a blade seat and a guard member. A plurality of first guard ribs are disposed on the platform member, and a first blade is disposed on the blade seat. A spacer is disposed on the first blade, and a plurality of second guard ribs is disposed on the spacer. A second blade is disposed on the spacer, and a cap member is disposed on the second blade. A plurality of third guard ribs is disposed on the cap member proximate the skin engaging edge of the second blade. The first, second and third guard ribs are arranged in a number of shapes and positions relative to each other, which assist the shaver in controlling blade exposure and shaving angle. Typically, the blade exposure is positive at the trough portion between the guard ribs, and negative at the tip portion an a shaving plane on skin engaging portion of the guard ribs.

24 Claims, 21 Drawing Sheets

RAZOR BLADE CARTRIDGE WITH GUARD RIBS

This application is a Continuation-in-Part of application Ser. No. 09/161,422 entitled "Razor Blade Cartridge with Guard Ribs" filed Sep. 24, 1998 now U.S. Pat. No. 6,378,211 with named inventors, which in turn is based upon Provisional Patent Application entitled "Virtual Guard Twin Blade Razor Cartridge" filed on Apr. 14, 1998, Ser. No. 60/081,589 with named inventor Jeffrey Wonderley, and upon Provisional Patent Application entitled "Virtual Guard Single Blade Razor Cartridge" filed on Apr. 17, 1998, Ser. No. 60/082,261 with named inventors Jeffrey Wonderley and Gregory McCool. It is also based upon Provisional Patent Application entitled "Improved Razor Blade Cartridge With Guard Ribs," filed on Jun. 21, 2000, Ser. No. 60/212,842 with named inventors Gregory F. McCool, and Jeffrey W. Wonderley.

BACKGROUND OF THE INVENTION

The present invention relates to wet shaving systems of the blade type and more particularly to a shaving system having one or more blades positioned within a blade cartridge and having cutting edges protected by guard ribs.

Shavers have long sought a wet shaving system that provides a smooth and comfortable shave without causing annoying cuts and abrasions on the skin of the shaver. In many instances the blade being at the wrong blade exposure or an improper shaving angle causes cuts and abrasions.

The terms "blade exposure" and "shaving angle" represent geometrical relationships between the blade and the shaving surface. These terms as well as another term commonly used in the art are defined as follows. First, the term "shaving plane" means the plane tangent to skin engaging surfaces, referred to as a guard and a cap, which are disposed on both sides of the blade so as to engage the shaving surface before and after engagement by the blade. Second, the term "blade exposure" means the distance by which the blade edge projects forward of the shaving plane. Third, the term "shaving angle" means the acute angle between a plane tangent to the cutting edge of the blade and the shaving plane.

Various approaches have been used in an effort to present a blade cartridge having the correct blade exposure and shaving angle. One approach disclosed in related art patents includes the configuration of a blade cartridge having blades that are movably mounted therein such that when force is applied to the blades they move to a less aggressive blade exposure and shaving angle. A second approach is to pivotally mount the blade cartridge to a handle that allows the entire cartridge to rotate in response to shaving forces to a less aggressive blade exposure and shaving angle.

A third approach involves constructing a blade cartridge wherein the blade assembly, including the blades, a spacer, and a cap member, are movable as a unit between various blade exposures and shaving angles within various degrees of control and direction in response to forces encountered during shaving. For example, Ciaffone et al., U.S. Pat. No. 4,461,079, describes a razor cartridge comprising a body portion 10 which includes a guard bar 12 (FIGS. 1–5). The guard bar 12 defines a leading skin-engaging surface fixed to the body portion. Rear beam 17 spans end walls 14 and 16 of the body portion 10 and a medial support member 13 to join the front of the cartridge 12 to the end thereof. A plurality of generally flat coplanar segments 18, 19, 21, and 22, each having an opening 23, are hinged to the rear beam 17 by mating webs 24, 26, 27, and 28 (col. 2, lines 50–52). Collectively, the segments 18, 19, 21, and 22 define a blade seat which is operable to pivot about the beam 17, thereby changing the attitude of blade edge relative to guard bar 12 (col. 2, lines 53–57). A cap 33 is apparently placed above an assembly of two skin-engaging blades 34 and 36 straddling a spacer 37 (FIG. 3). The two blades and the spacer are secured to one coplanar segment 21 of the blade support or blade seat by a conventional rivet 38 to form a rigid unit. A hinge 27 connects the coplanar segment 21 to the rear-beam 17 (col. 3, lines 1–8). As compared to the position of the blade edges relative to the guard bar at the normal or free position set in accordance with a predetermined blade geometry (FIG. 3), a change in blade geometry occurs during the course of shaving when a shaving force F causes the blade package to rotate or pivot about rear-beam 17 in the direction of arrow R where the blade edges are rendered less "aggressive" (FIG. 4, col. 3, lines 13–23). Upon relaxation of shaving forces, the elastic memory of hinges 24, 26, 27, and 28 forces the blade seat, and therefore the blade edges, to return to their normal position (FIG. 3., col. 3, lines 24–26).

Other approaches include foil guarded cartridges, taped blades and wire wrapped blades or cartridges. Foil guarded cartridges are typically constructed with a piece of foil extending over the cap member, the blades and the platform member. The foil has openings adjacent the blade edges to allow the blade edge to contact the skin of the shaver. Taped blades include a piece of material extending from the upper surface of the blade over the blade edge to the lower surface of the blade. The material has openings positioned along the blade edge to allow the blade edge to contact the skin of the shaver. Wire wrapped blades include a piece of wire extending around the entire blade and over the blade edge. Alternatively, the piece of wire can be wrapped around the entire blade assembly and over the blade edges, to form a wire wrapped blade cartridge.

The various approaches discussed above present several different problems. First, the cost of manufacturing these blade cartridges is high. The relatively complex mechanisms used to produce blade cartridges having movable blades or movable blade assemblies significantly increases the cost to produce and assemble such blade cartridges. Similarly, wire wrapped, foil guarded and taped blades are difficult and expensive to assemble adding cost to the finished product.

A second problem with the movable blade cartridges described above is the delicate, and sometimes unpredictable, nature of the movable blades. By movably mounting a blade within a blade cartridge, the risk arises that the blade may move to a more aggressive blade exposure or shaving angle, thereby cutting the shaver. Additionally, by movably mounting a blade within a blade cartridge, the risk arises that the movable connection may fail and the blade may become dislodged from the blade cartridge.

A second problem with the wire wrapped, foil guarded, and taped blade approaches is that they tend to grab and pull whiskers that become caught between the protective member and the blade. They also tend to collect debris and are hard to flush clean. The foil guarded, taped blade, and wire wrapped cartridges are limited in how close of a shave they can produce by the thickness of the foil, tape, or wire (diameter) used to cover the blades. The wire wrapped blades have the disadvantage that the wire tends to embed itself into the blade thereby damaging the blade. Additionally, the wires are easily disturbed thereby effecting shaving characteristics of the blade and potentially causing wear on the blade edge.

Consequently, a need exists for a blade cartridge incorporating an effective means for preventing cuts and abrasions caused by a razor blade being repeatedly passed over the skin of a shaver. The blade cartridge should be constructed to provide proper blade exposure and shaving angle, while still providing a close shave. The blade cartridge should also be cost effective to manufacture and durable. In addition, the blade cartridge should be configured to effectively shave varying contours and surfaces.

SUMMARY OF THE INVENTION

The blade cartridge of the present invention has one or more protruding members, or guard ribs, positioned proximate the skin engaging edges of the blades such that a portion of the blade adjacent the guard ribs has a negative exposure. The guard ribs provide an effective means for preventing cuts and abrasions caused by a razor blade being repeatedly passed over the skin of a shaver. The guard ribs provide the portions of the skin engaging edges with a negative blade exposure that prevents overexposure of the blades to the skin, while allowing the remainder of the skin engaging edges of the blade to still provide a close shave. The blade cartridge is cost effective to manufacture and durable, in that the present invention provides a simple arrangement without moving parts. In addition, the blade cartridge is configured to provide an effective shave on a variety of contours and surfaces. The plurality of guard ribs on the guard, spacer and cap define a blade exposure at a shaving plane at a tip of said guard ribs from between about −0.762 mm to −1.5 mm, and a blade exposure at a trough from between about +0.508 mm to about +1.270 mm.

Preferably, the blade cartridge is connected to a handle, and can be detachably connected so as to allow the blade cartridge to be replaced when it becomes worn. Alternatively, the blade cartridge may be permanently mounted on or integrally attached to a handle in the form of a disposable razor.

The present invention further includes one or more protruding members, or guard ribs, evenly positioned along the blade cartridge. The guard ribs preferably each have an arcuate contact surface and are narrow in thickness in a direction along the skin engaging edge. In addition to the guard ribs on the platform member, the present invention preferably further includes protruding members, or guard ribs, on the cap member. The guard ribs on the platform member are preferably aligned with and substantially continuous with the guard ribs on the cap member.

In a further embodiment, the blade cartridge includes a secondary blade and a spacer separating the primary blade and the secondary blade. In this embodiment the spacer preferably has protruding members, or guard ribs, positioned proximate the skin engaging edges of the primary and secondary blades. In this embodiment the spacer preferably has an open portion abutting the aperture in the primary blade that allows debris to flow through the resulting flow path and out the bottom of the blade cartridge. As with previous embodiments, the guard ribs on the spacer are preferably aligned with and substantially continuous with the guard ribs on the cap member and the platform member. Similarly, additional spacers with protruding members and additional blades may be added to the blade cartridge to produce further embodiments.

The invention itself, together with further objects and advantages, will best be understood by reference to the following detailed description taken in conjunction with the accompanying drawings.

BRIEF DESCRIPTION OF THE DRAWINGS

FIGS. 1 though 21 are presented by way of illustration and not by limitation to depict the preferred embodiments of the present invention. Embodiments including the various aspects of the present invention will now be described in detail with reference to the accompanying drawings.

DETAILED DESCRIPTION OF THE INVENTION

Figure 1:
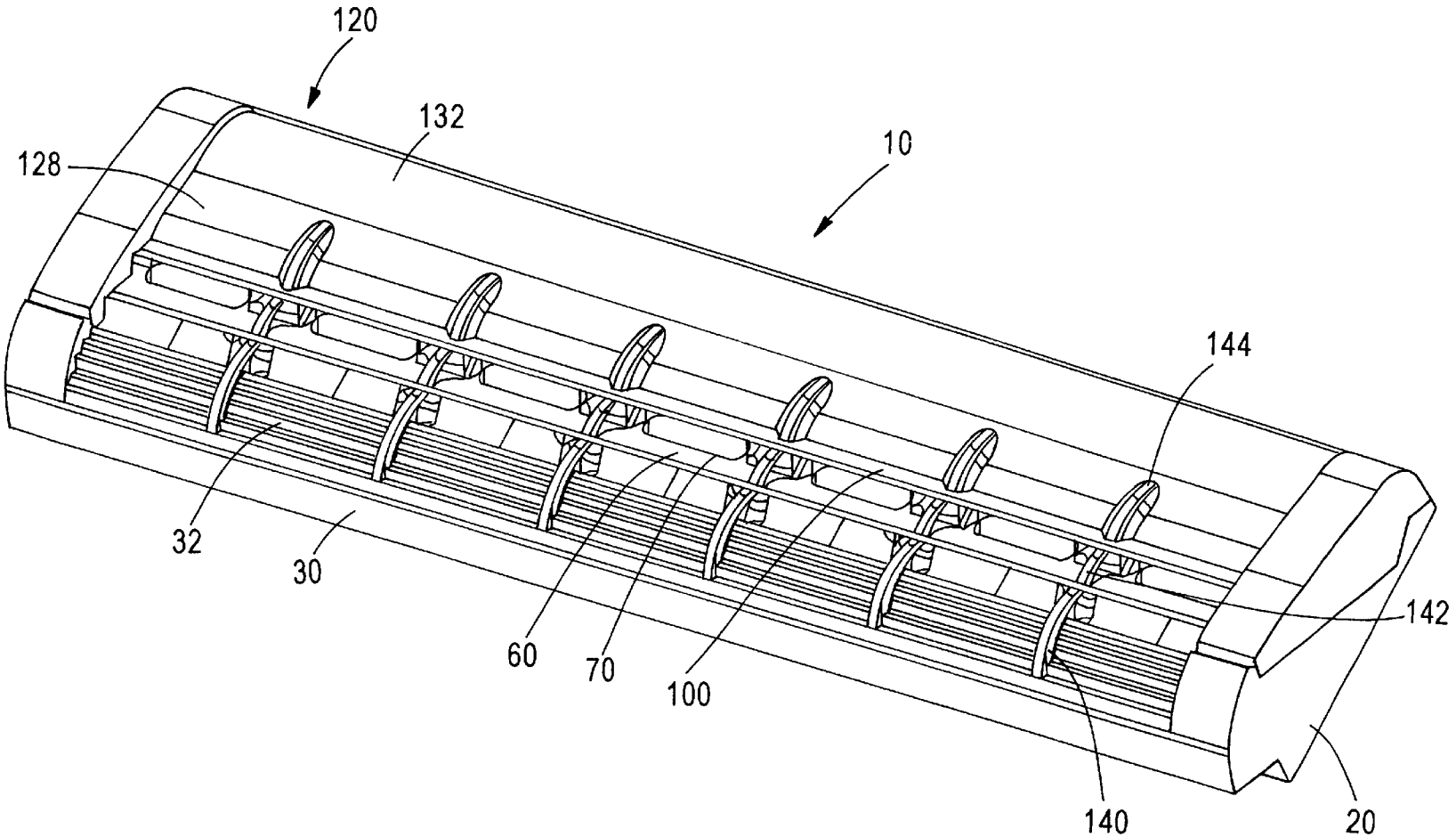
FIG. 1 is a top perspective view of a first embodiment having twin blades of a razor blade cartridge according to the present invention.
Figure 2:
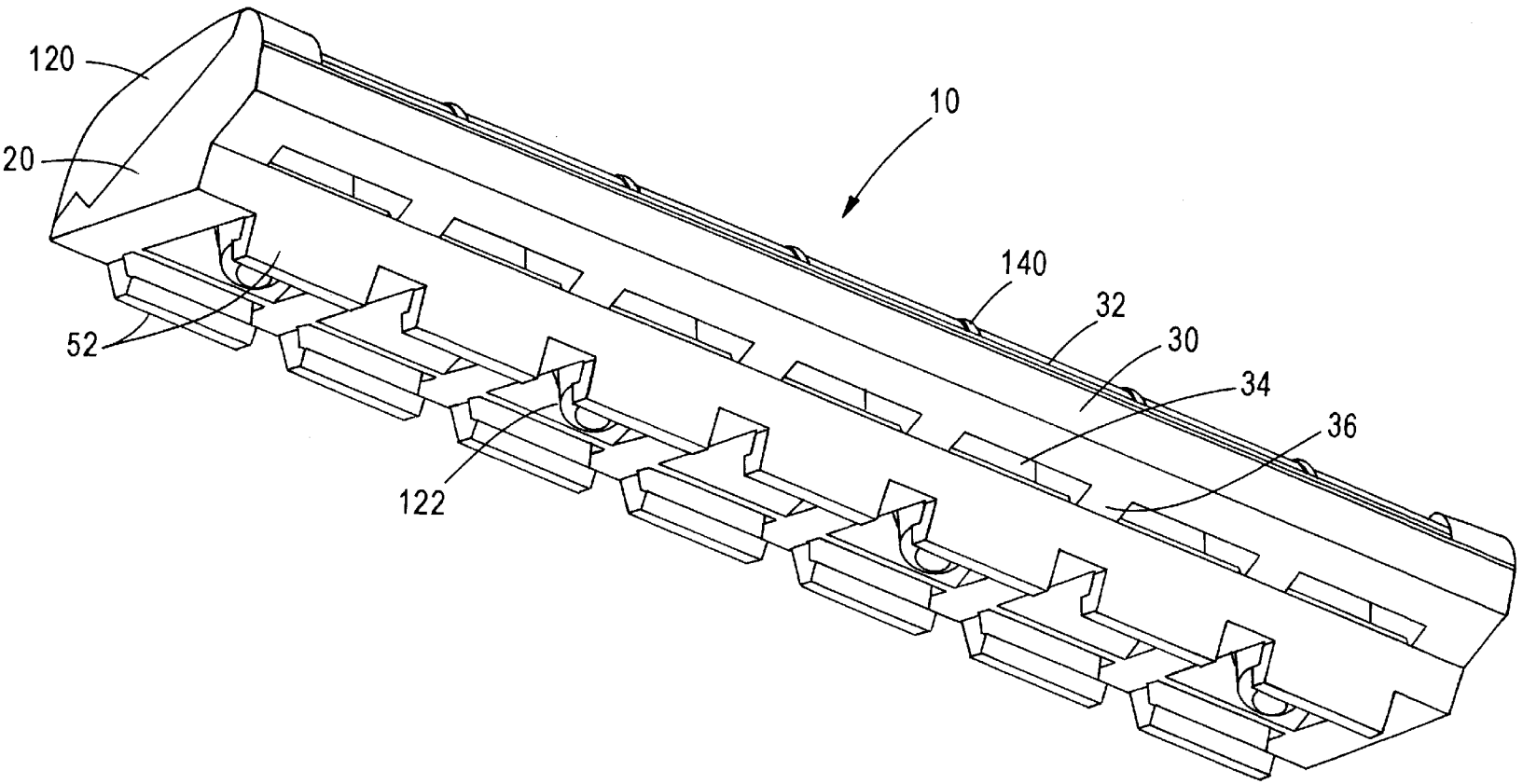
FIG. 2 is a bottom perspective view of a first embodiment having twin blades of a razor blade cartridge according to the present invention.
Figure 3:
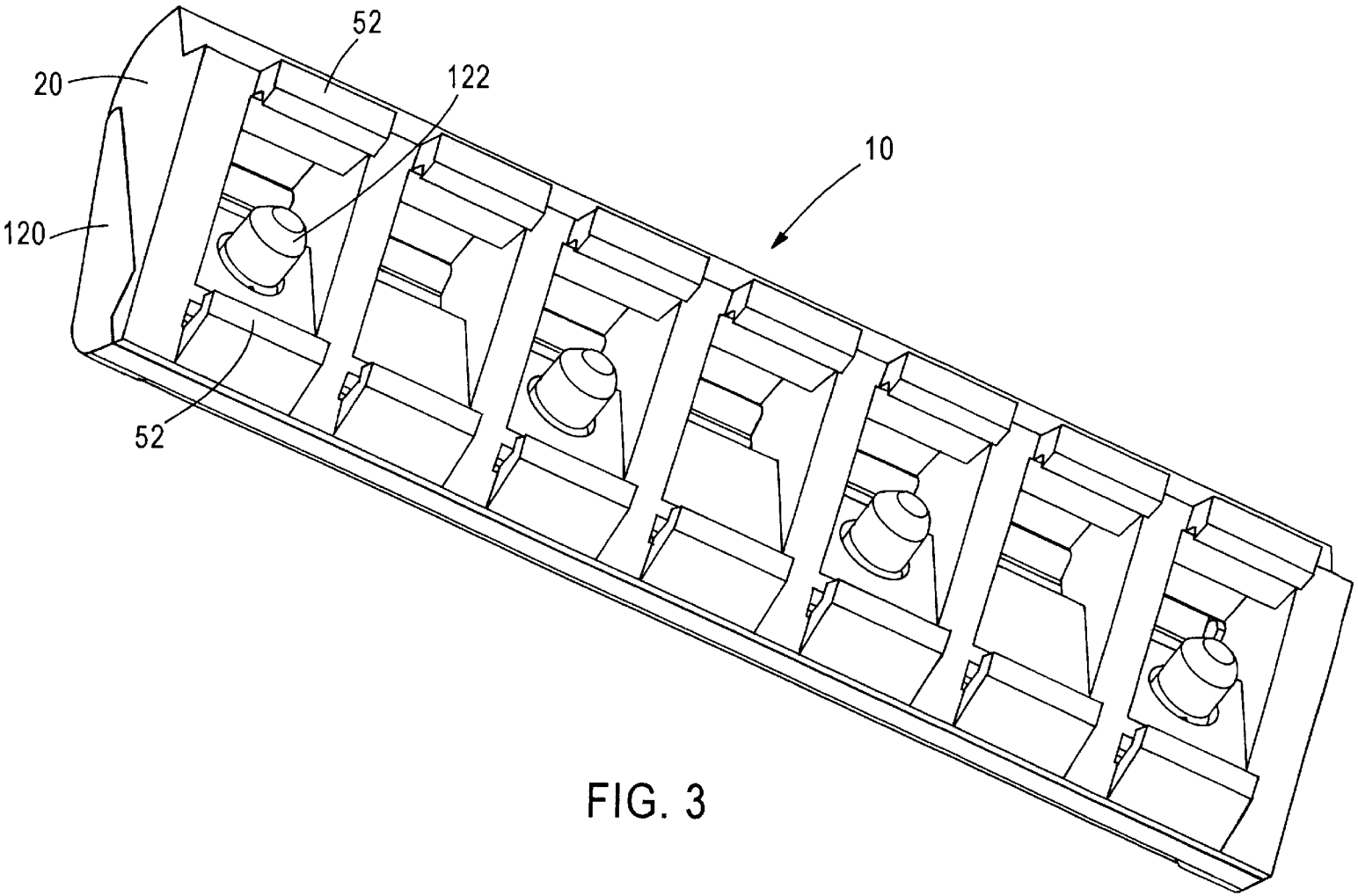
FIG. 3 is a bottom perspective view of a first embodiment having twin blades of a razor blade cartridge according to the present invention.
Figure 4:
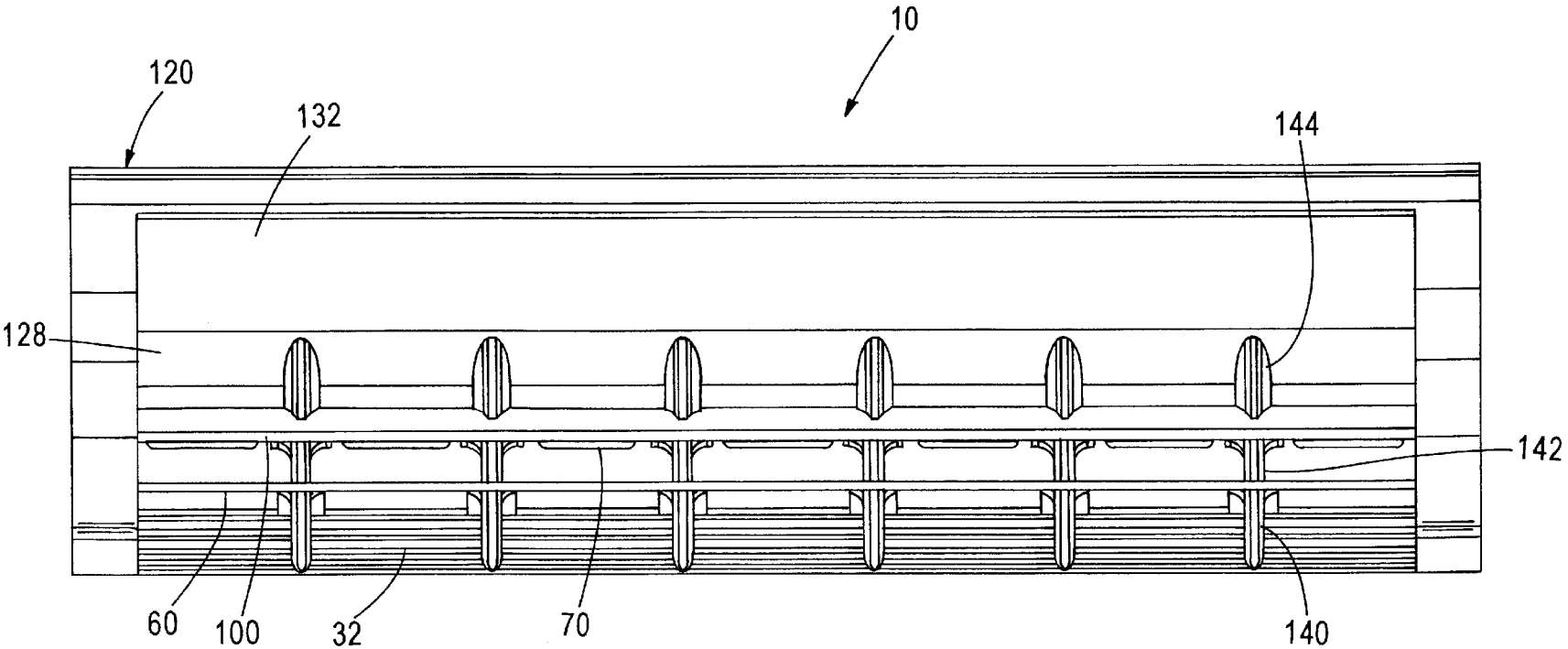
FIG. 4 is a top plan view of a first embodiment having twin blades of a razor blade cartridge according to the present invention.
Figure 5:
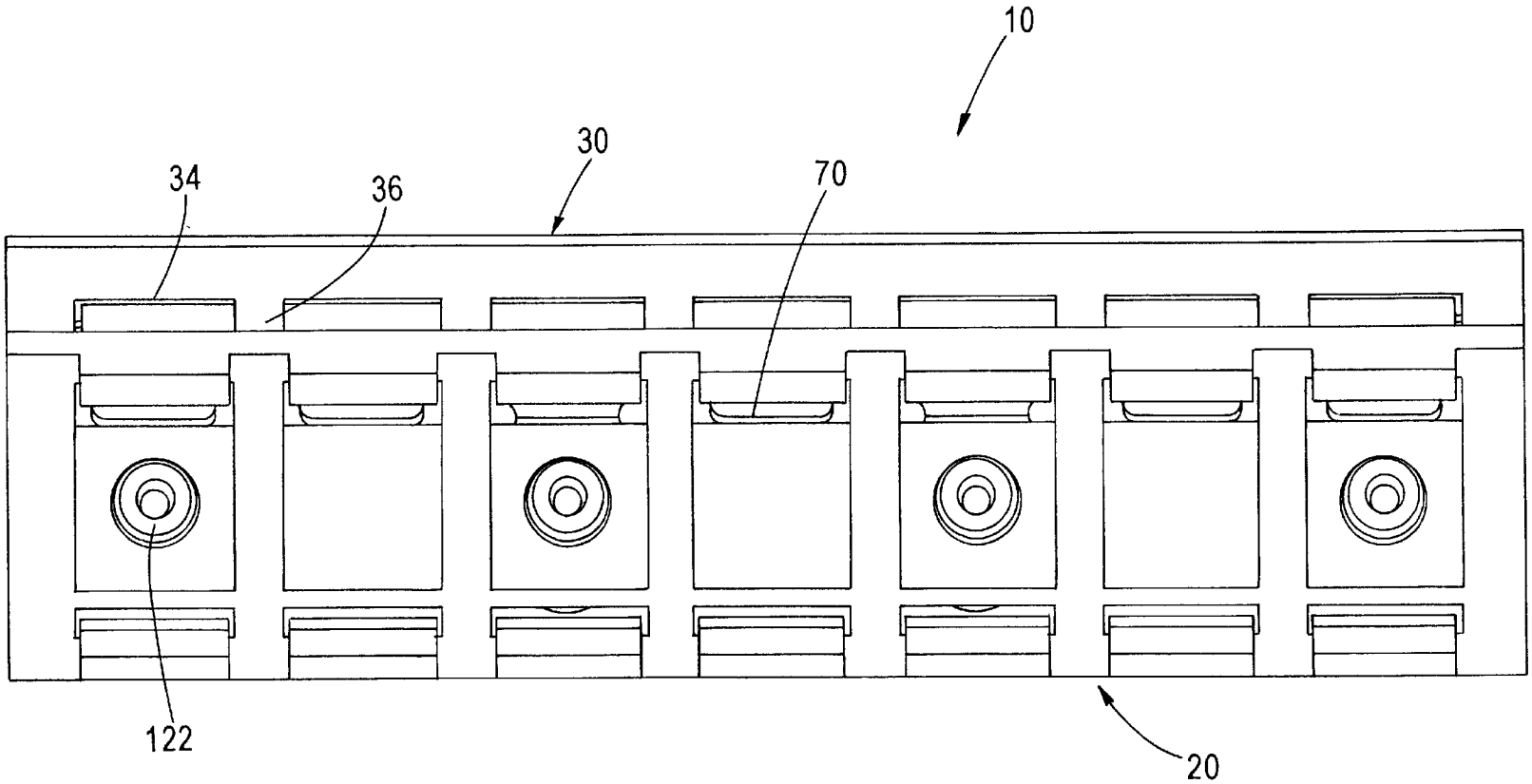
FIG. 5 is a bottom plan view of a first embodiment having twin blades of a razor blade cartridge according to the present invention.
Figure 6:
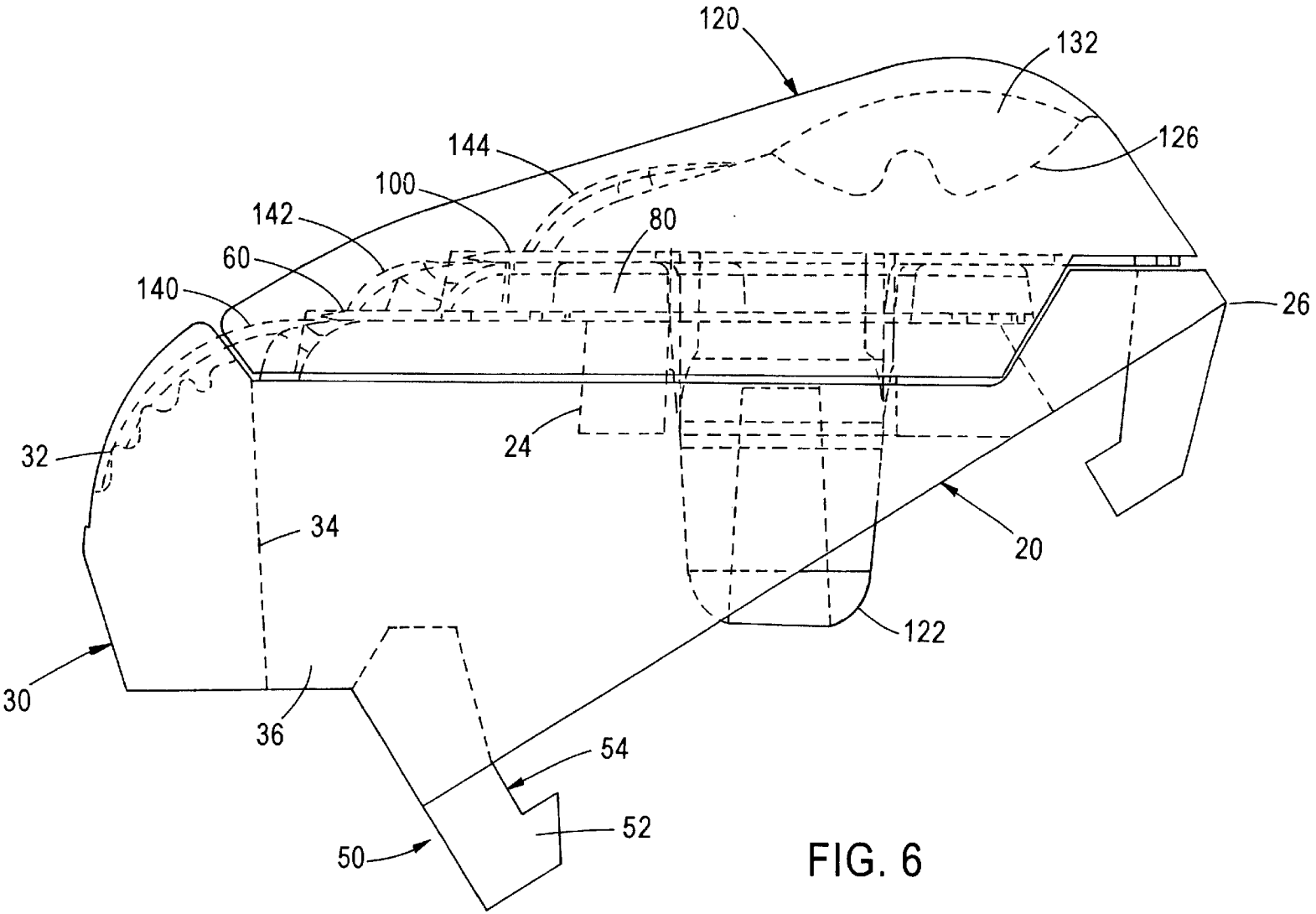
FIG. 6 is a side view, including phantom lines, of a first embodiment having twin blades of a razor blade cartridge according to the present invention.
Figure 7:
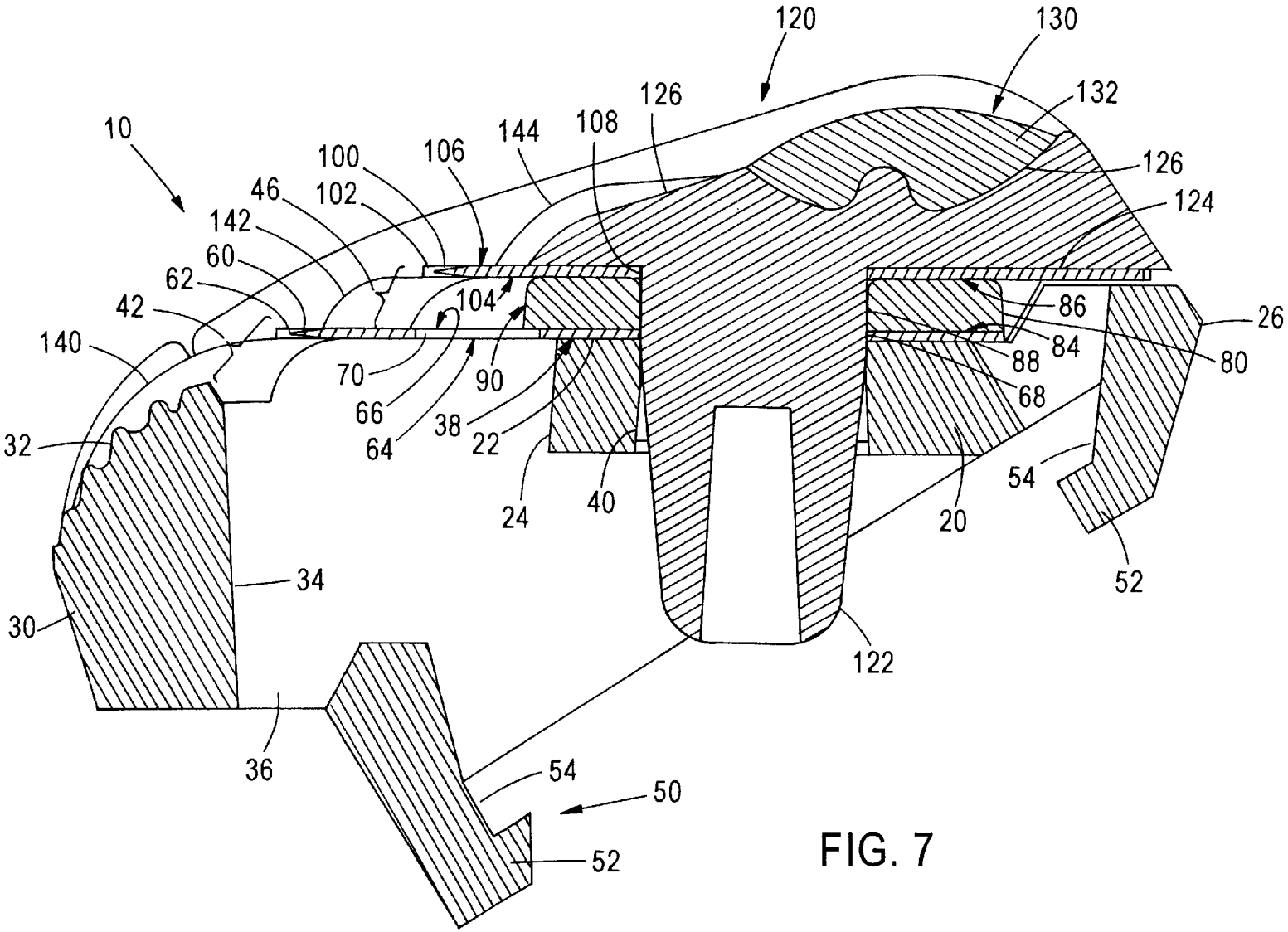
FIG. 7 is a cross-sectional view along a rivet of a first embodiment having twin blades of a razor blade cartridge according to the present invention. A—A
Figure 8:
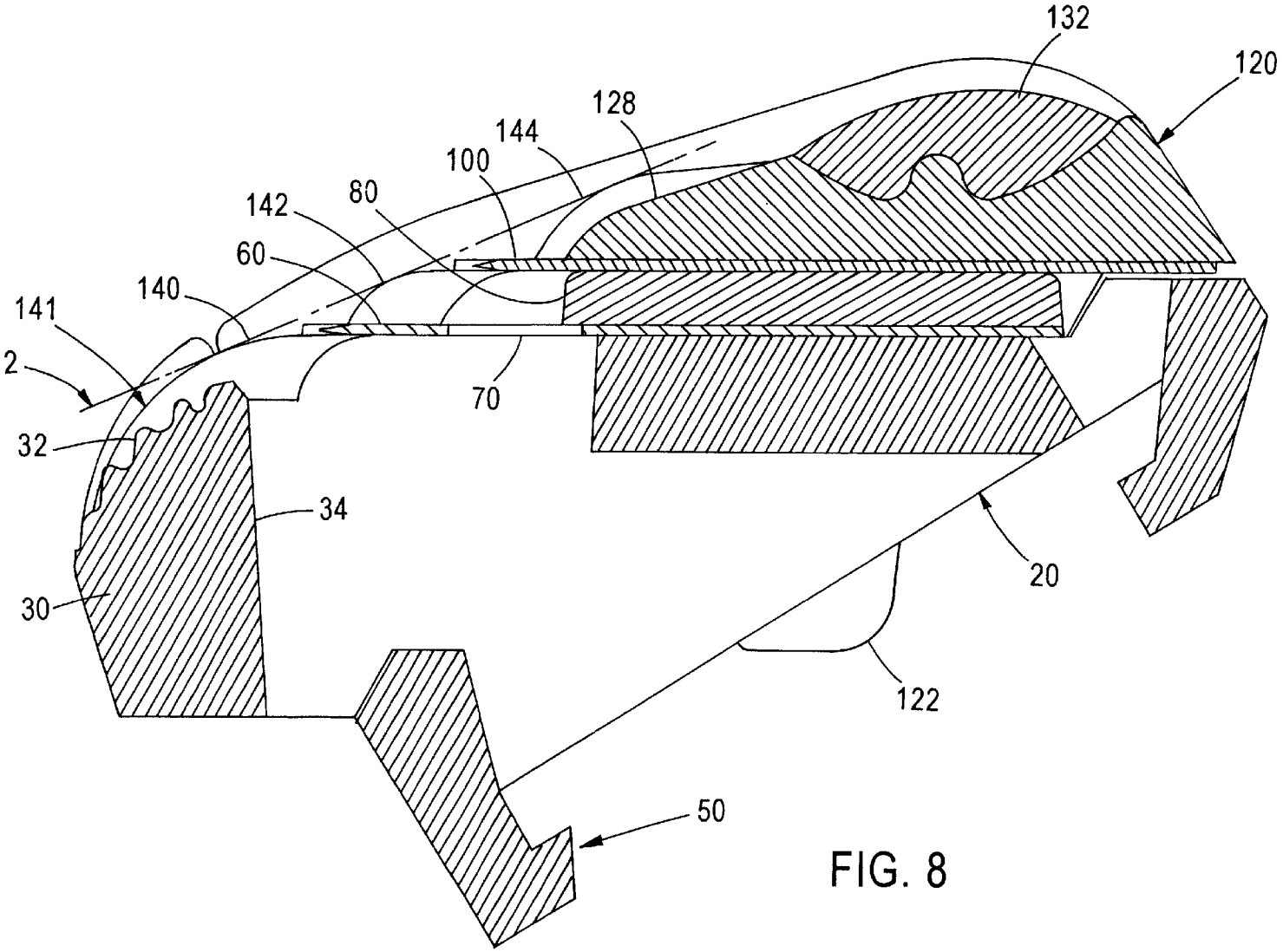
FIG. 8 is a cross-sectional view of a first embodiment having twin blades of a razor blade cartridge according to the present invention. B—B
Figure 9:
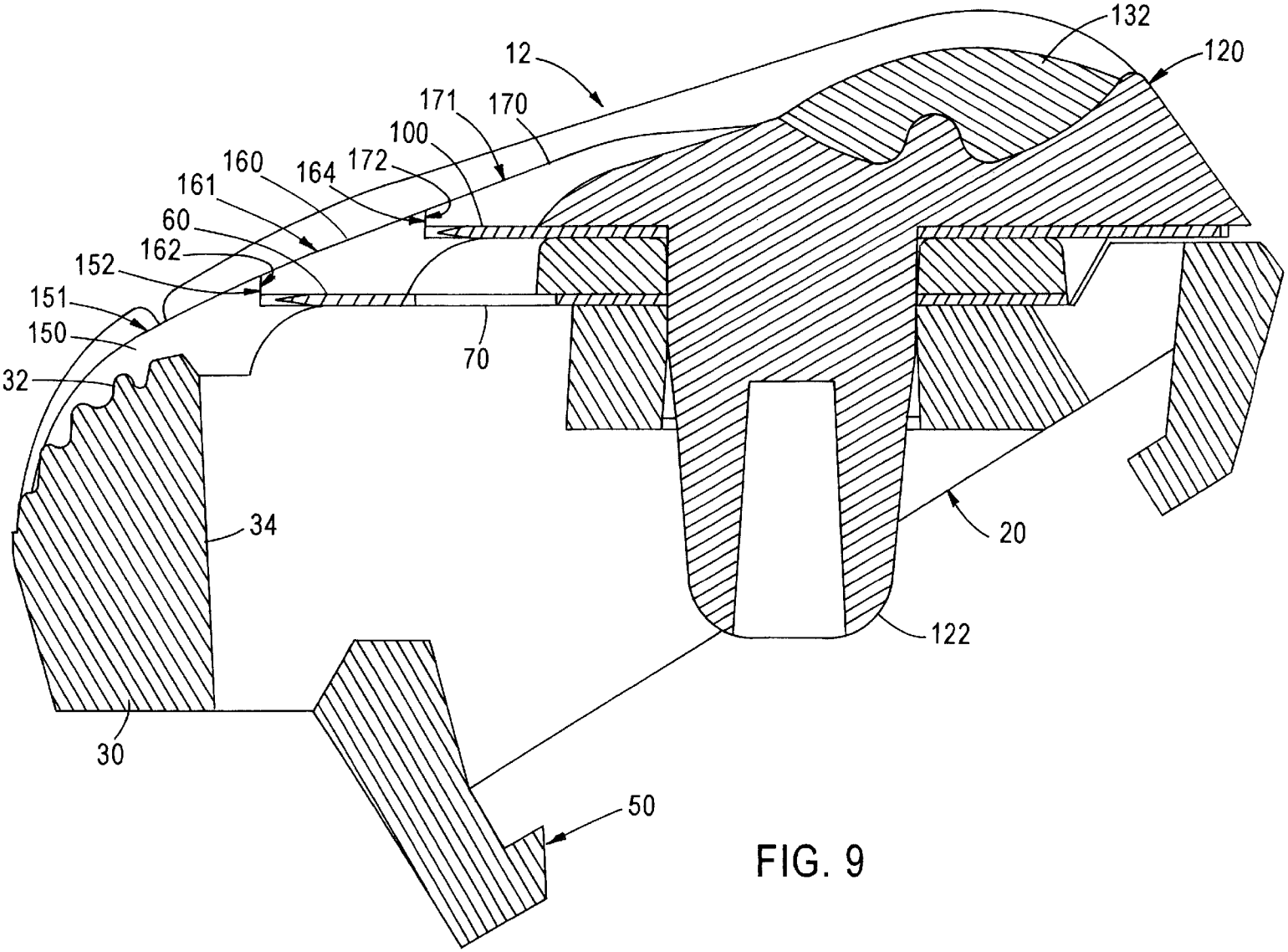
FIG. 9 is a cross-sectional view along a rivet of a second embodiment having twin blades and continuous guard ribs of a razor blade cartridge according to the present invention.
Figure 10:
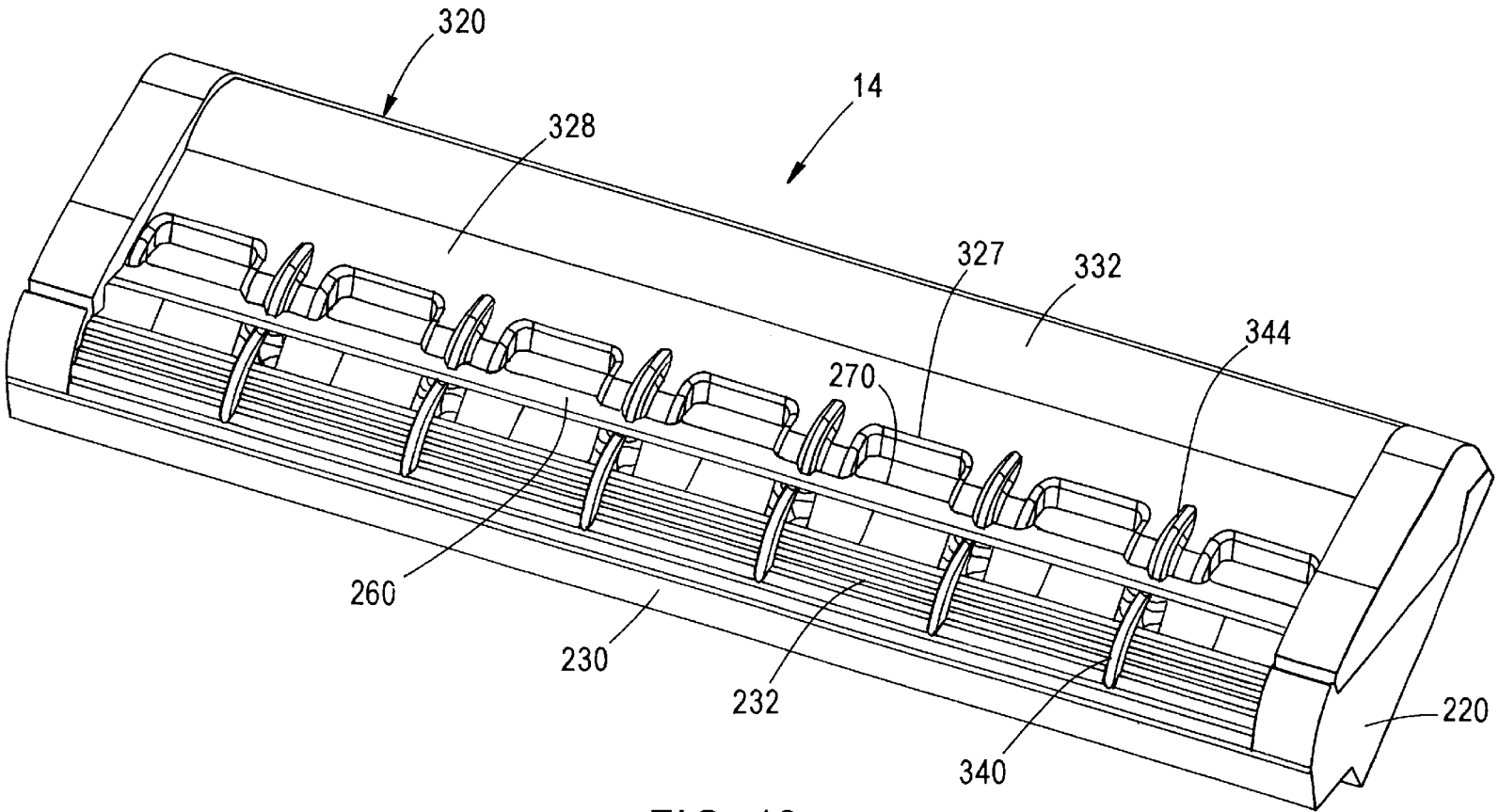
FIG. 10 is a top perspective view of a third embodiment having a single blade of a razor blade cartridge according to the present invention.
Figure 11:
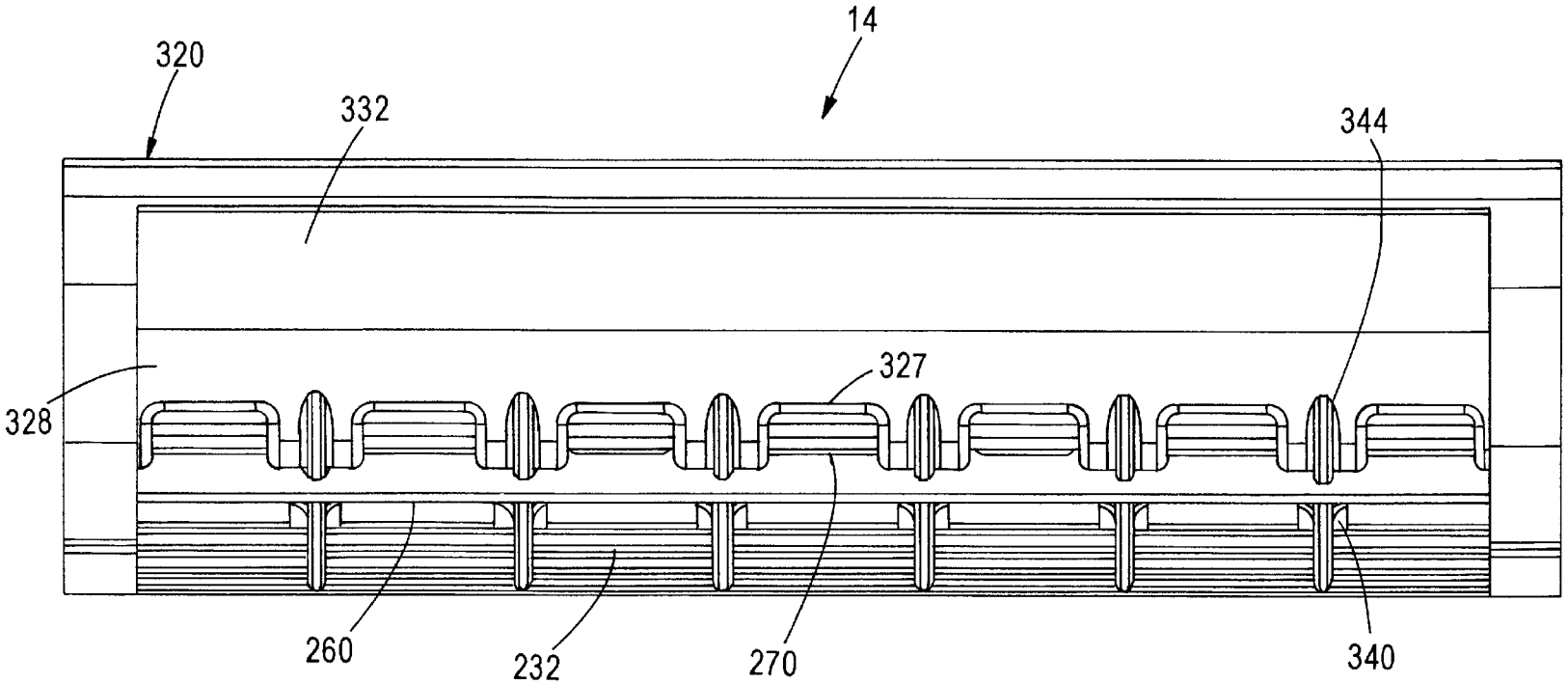
FIG. 11 is a top plan view of a third embodiment having a single blade of a razor blade cartridge according to the present invention.
Figure 12:
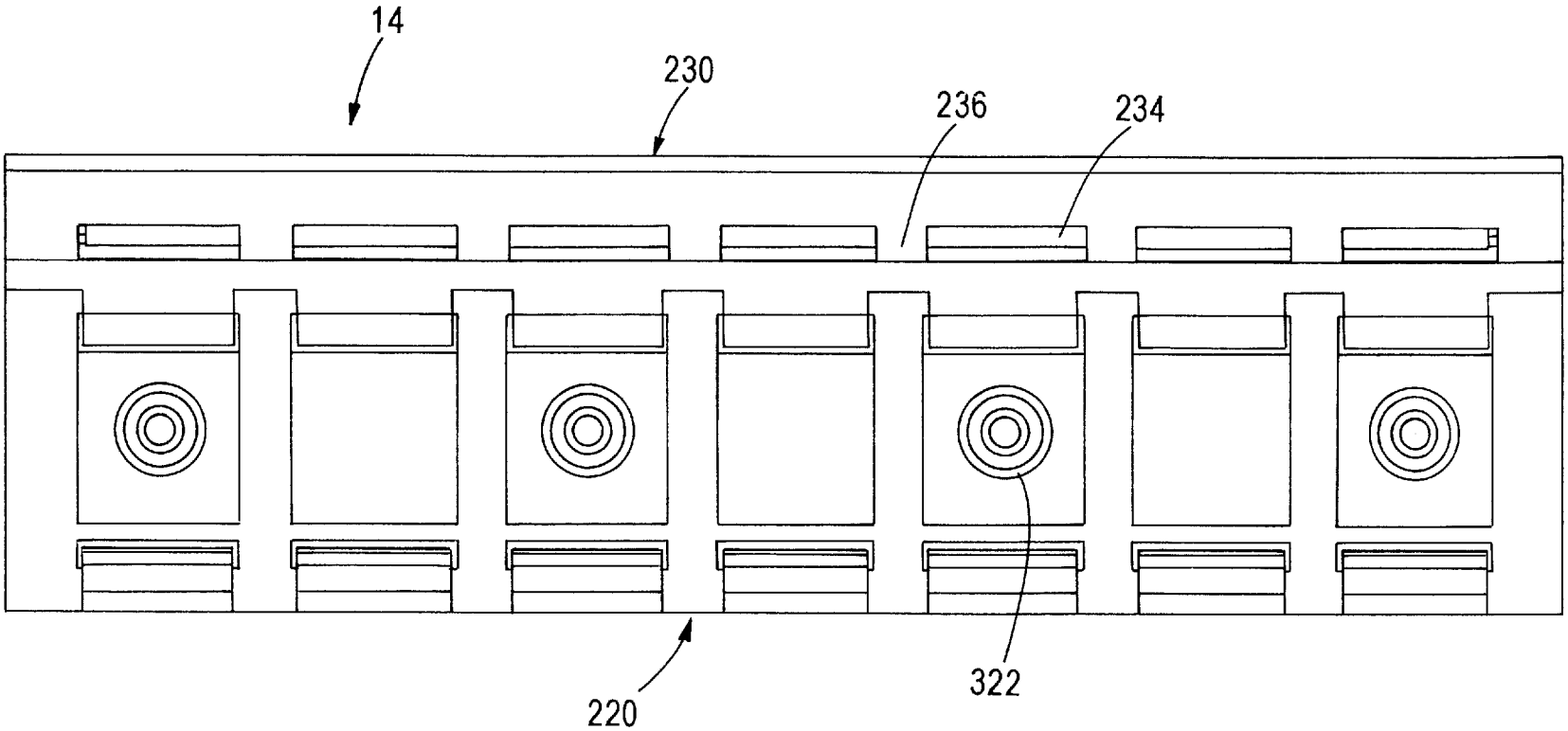
FIG. 12 is a bottom plan view of a third embodiment having a single blade of a razor blade cartridge according to the present invention.
Figure 13:
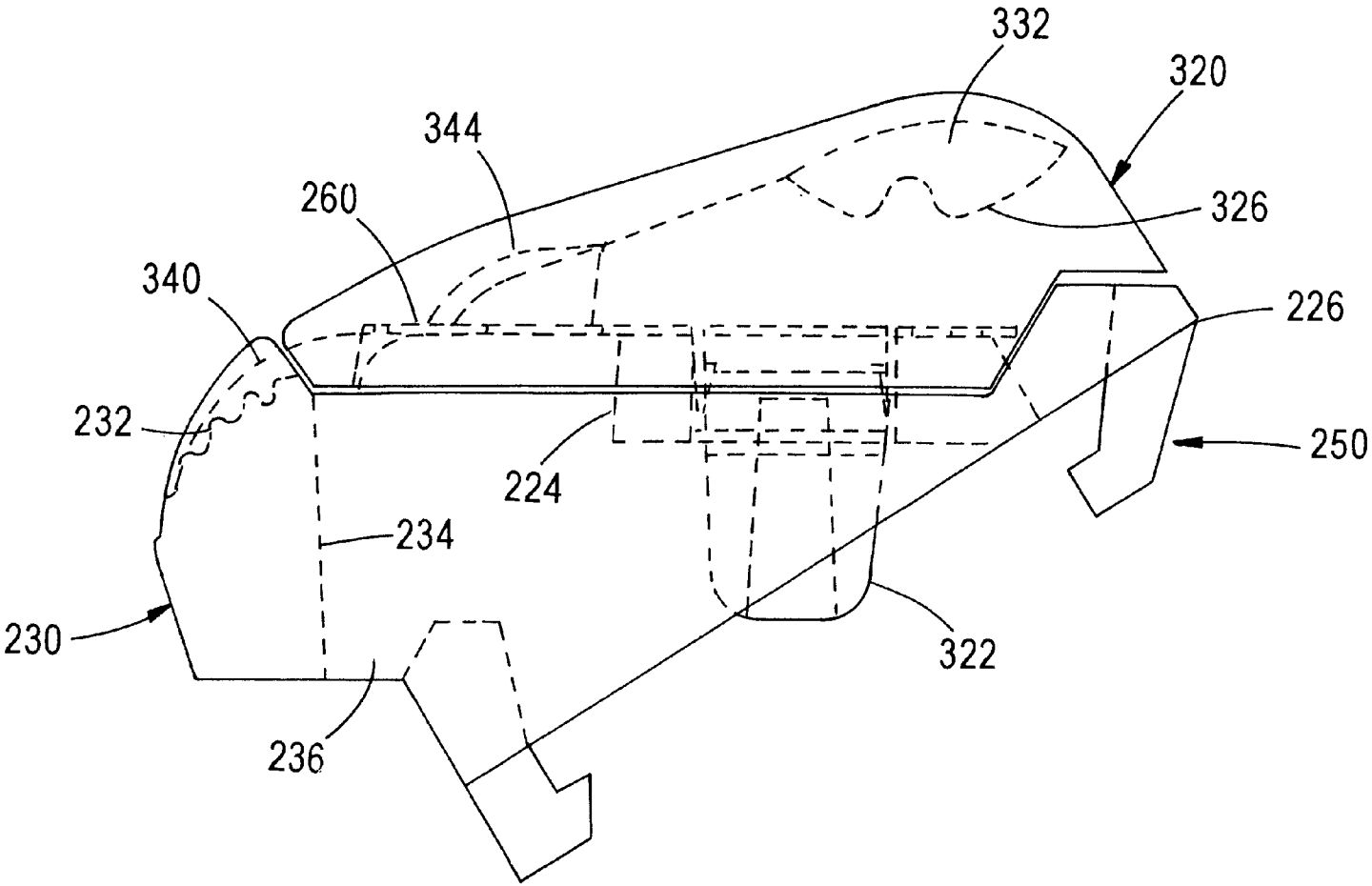
FIG. 13 is a side view, including phantom lines, of a third embodiment having a single blade of a razor blade cartridge according to the present invention.
Figure 14:
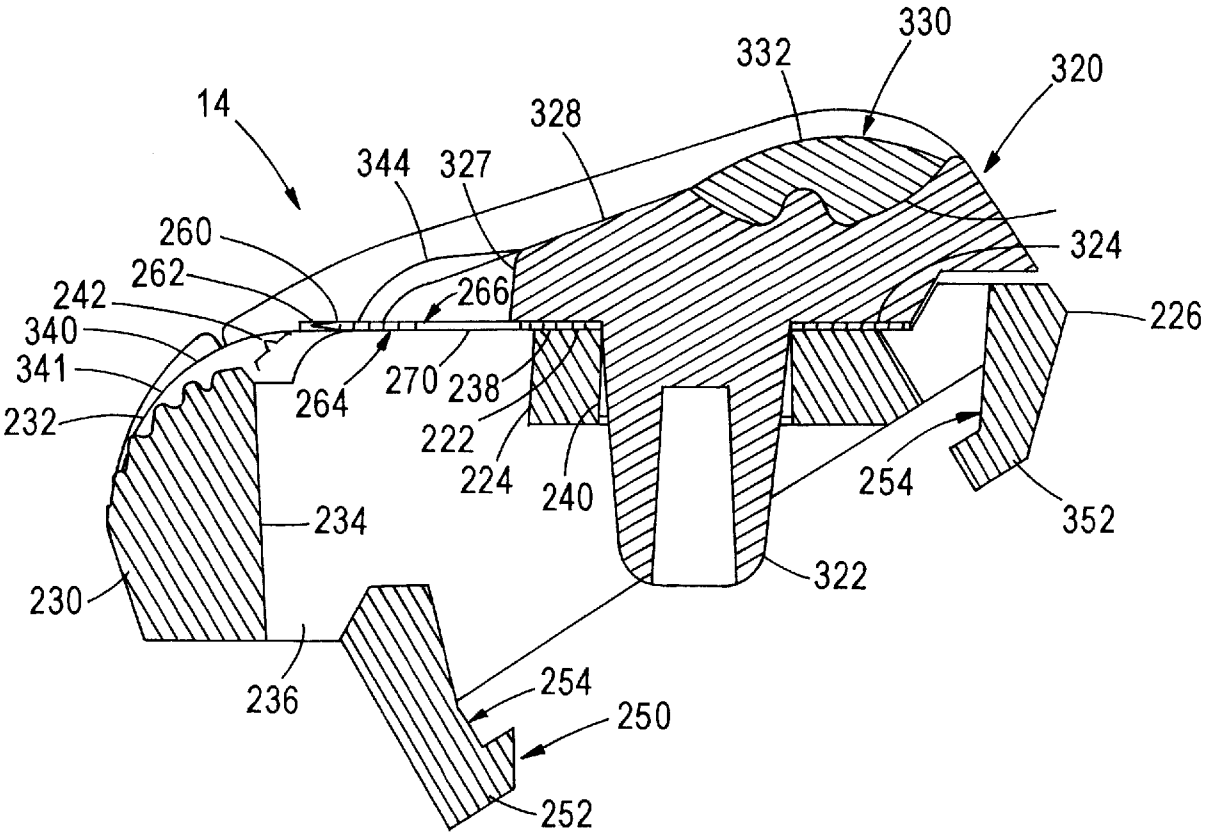
FIG. 14 is a cross-sectional view along a rivet of a third embodiment having a single blade of a razor blade cartridge according to the present invention.
Figure 15:
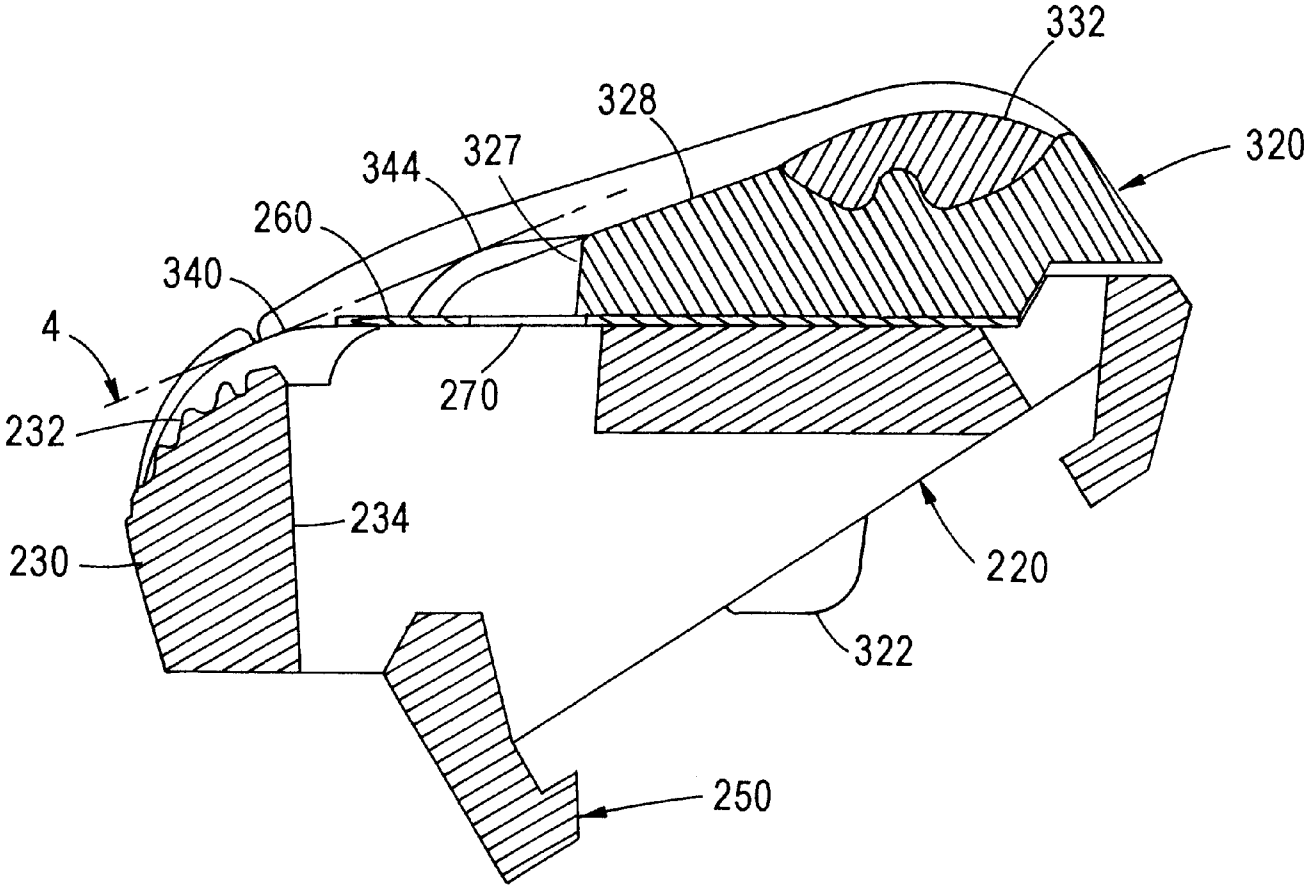
FIG. 15 is a cross-sectional view of a third embodiment having a single blade of a razor blade cartridge according to the present invention.
Figure 16:
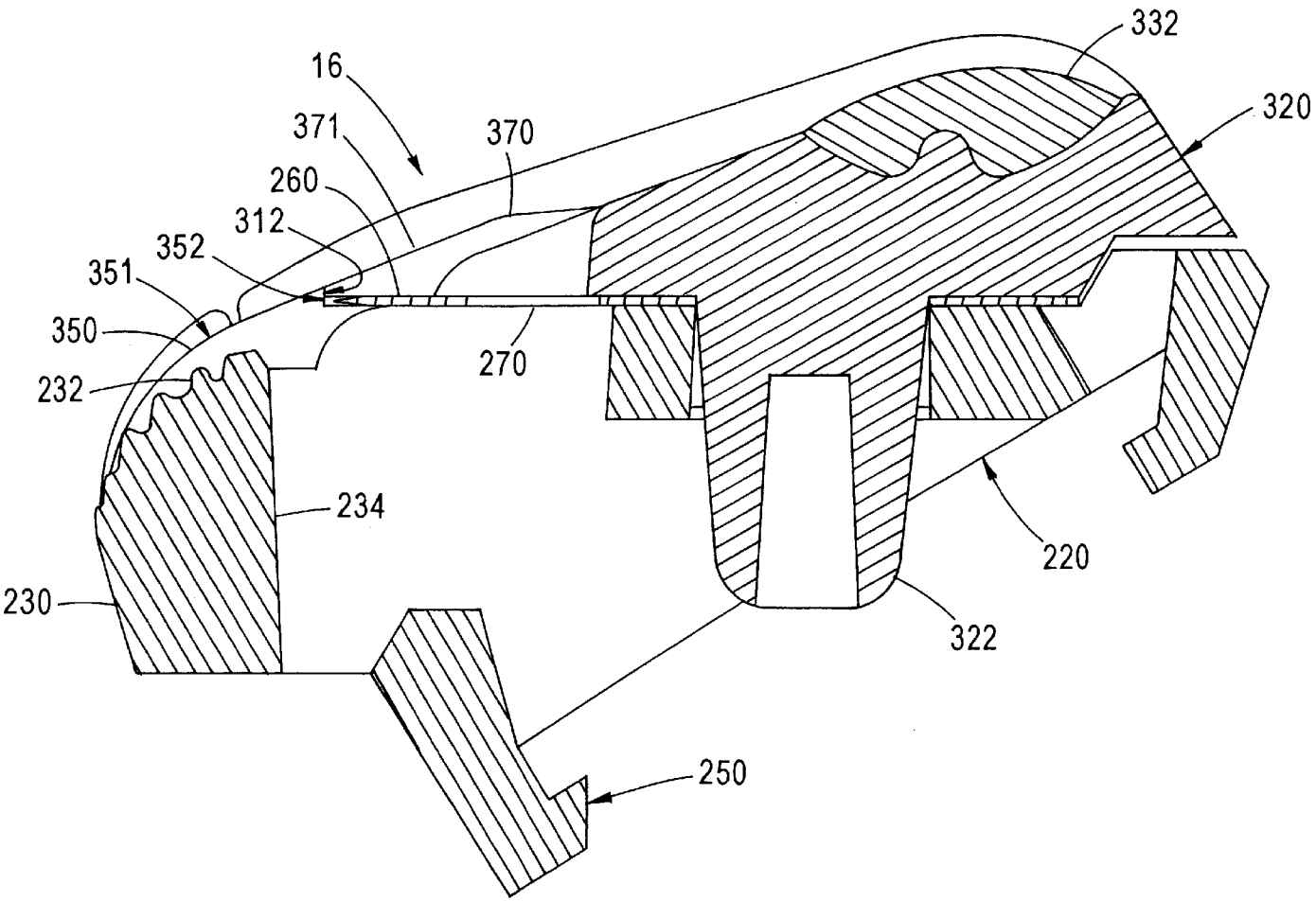
FIG. 16 is a cross-sectional view along a rivet of a fourth embodiment having a single blade and continuous guard ribs of a razor blade cartridge according to the present invention.
Figure 17:
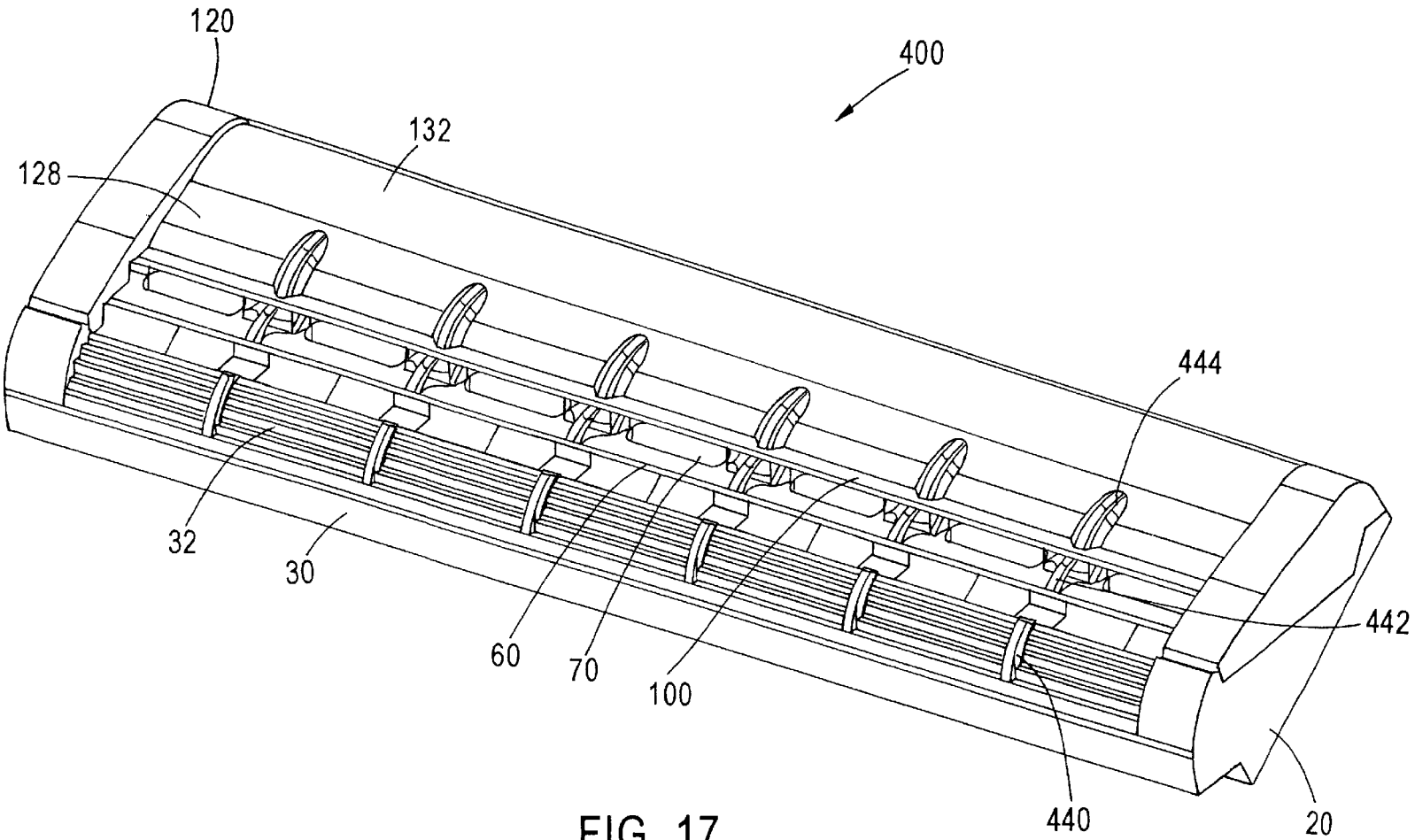
FIG. 17 is a top perspective view of a razor blade cartridge according to a fifth embodiment of the present invention.
Figure 18:
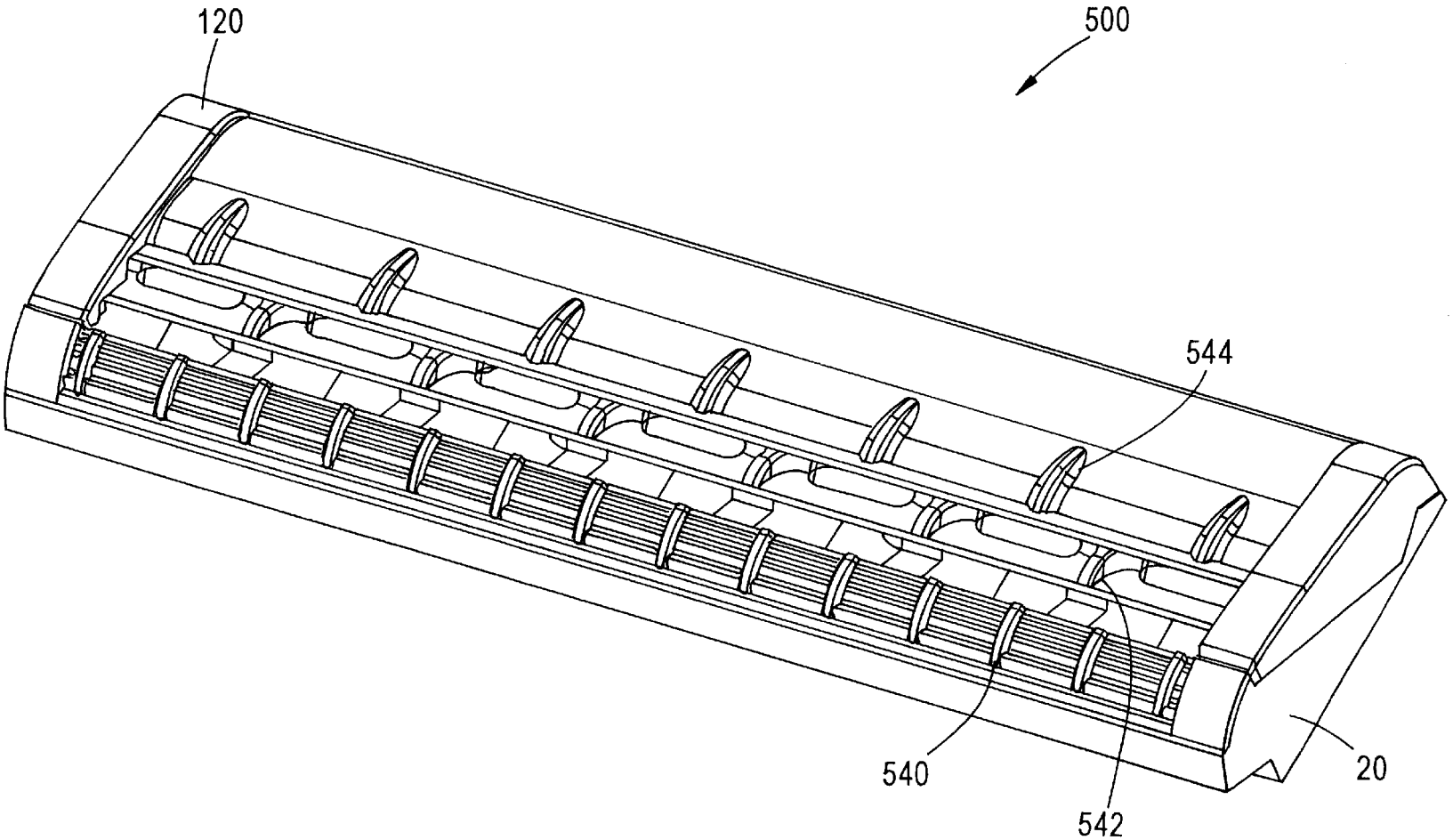
FIG. 18 is a top perspective view of a razor blade cartridge according to a sixth embodiment of the present invention.
Figure 19:
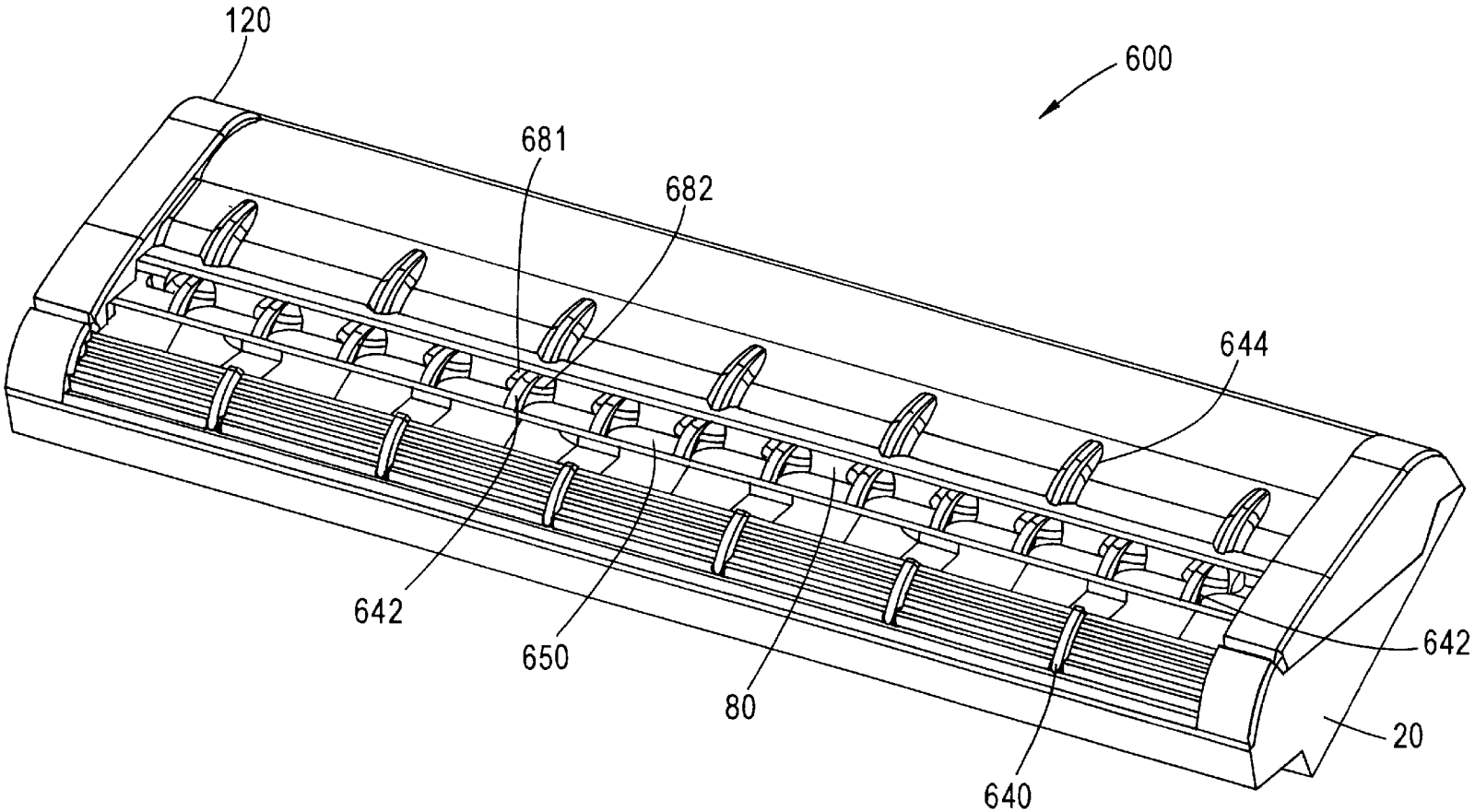
FIG. 19 is a top perspective view of a razor blade cartridge according to a seventh embodiment of the present invention.
Figure 20:
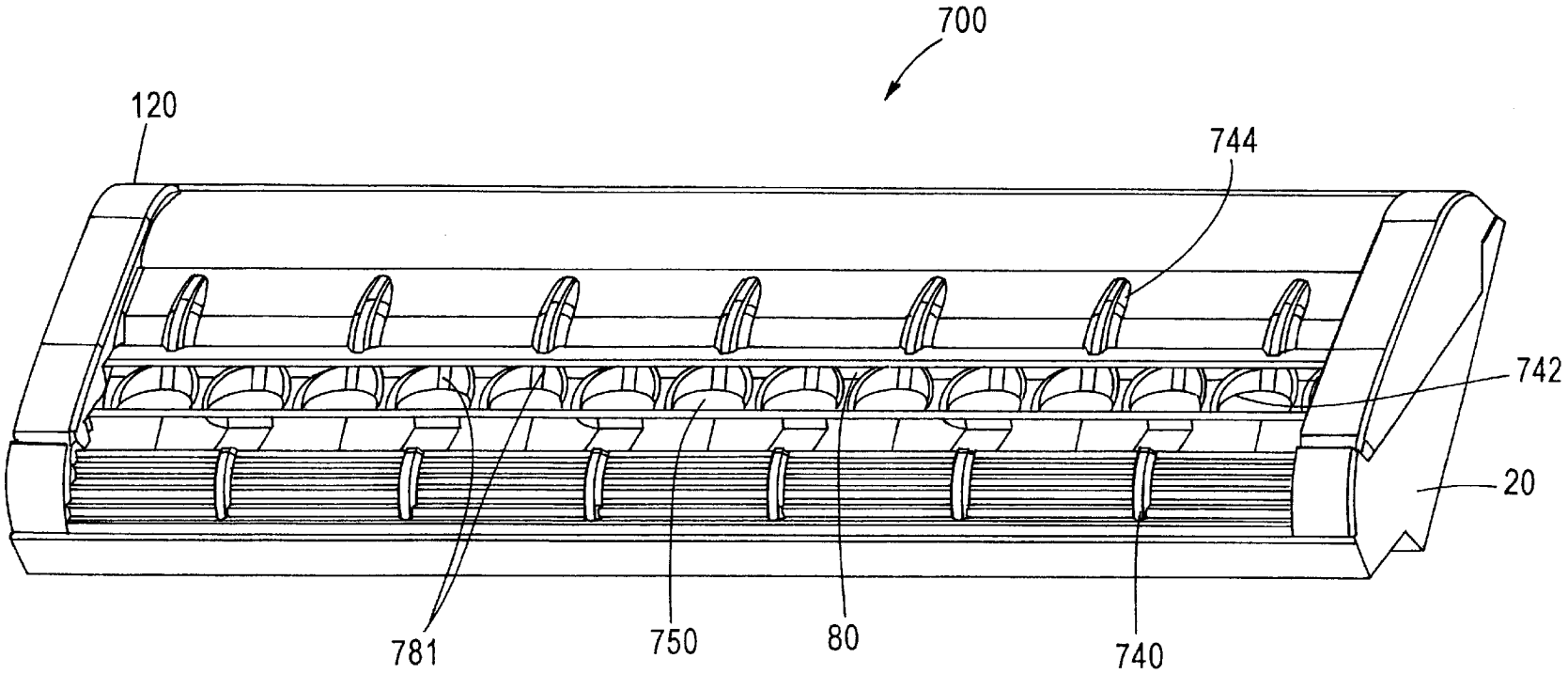
FIG. 20 is a top perspective view of a razor blade cartridge according to a eight embodiment of the present invention.

Turning now to the drawings, FIGS. 1–8 illustrate a first embodiment 10 of a blade shaving cartridge ("BSC" or blade cartridge) or razor head, FIG. 9 illustrates a second embodiment 12, FIGS. 10–15 illustrate a third embodiment 14, FIG. 16 illustrates a fourth embodiment 16, FIG. 17 illustrates a fifth embodiment 17, FIG. 18 illustrates a sixth embodiment 18, FIG. 19 illustrates a seventh embodiment 19, and FIG. 20 illustrates a eight embodiment 21.

Referring to FIGS. 1–8, the first embodiment of the present invention includes a platform member 20, a primary blade 60, a spacer 80, a secondary blade 100, and a cap member 120. As depicted in FIGS. 7 and 8, the platform member 20 includes a blade seat 22 having a front wall 24 and a rear wall 26. The guard member 30 extends parallel to the front wall 24 forming a flow channel or slot 34 between the guard member 30 and the front wall 24. The guard member 30 is connected to the front wall 24 by a plurality of support members 36, which extend substantially perpendicular to the longitudinal axis of the both the guard member 30 and the front wall 24. The guard member 30 placed in front of the first blade 60 is integral with the platform member 20 and is therefore stationary relative to the blade cartridge 10. The guard 30 being positioned in front of the first blade 60 has a raised skin engaging portion 32, which provides an engaging surface to control exposure of the first blade 60 to the shaver's skin.

The support members 36 extend downwardly away from the upper surface 38 of the blade seat 22 so as to create a gap 42 between a lower surface 64 of the first blade 60 and the guard member 30. The gap 42 allows for the passage of water and shaving debris beneath the first blade 60, through the slot 34, and out the bottom of the blade cartridge 10.

The blade seat 22 includes an upper surface 38, as well as a plurality of securing apertures 40. The securing apertures 40 operate in conjunction with staking pins (or rivets) 122 located on the cap member 120 to permanently secure the platform member 20, the blades 60 and 100, the spacer 80, and the cap member 120 together.

The blade cartridge 10 includes a primary or first blade 60 and a secondary or second blade 100 each having substantially parallel front and rear edges with the front edge of each blade defining a skin engaging edge or cutting edge 62 and 102, respectively. Each blade 60 and 100 defines a longitudinal axis that is parallel to the cutting edge of the blade 60 and 100 and a lateral axis that is perpendicular to the cutting edge of the blade 60 and 100.

The first blade 60 is fixed between the upper surface 38 of the blade seat 22 and a lower surface 84 of the spacer 80. The first blade 60 has a lower surface 64 and an upper surface 66. The first blade 60 includes securing apertures 68 which align with the securing apertures 40 of the blade seat 22 so as to allow the staking pins 122 to pass through the securing apertures 68 of the first blade 60, thereby securing the first blade 60 to the blade cartridge 10. In the first embodiment the first blade preferably has a plurality of apertures 70 along the forward portion thereof that allow debris to travel through the apertures 70 and out the bottom of the blade cartridge 10.

The spacer 80 functions to separate blades 60 and 100. As depicted in FIGS. 7 and 8, the spacer 80 has an upper surface 86 and a lower surface 84. The spacer 80 includes securing apertures 88 which align with the securing apertures 40 of the blade seat 22 so as to allow the staking pins 122 to pass through the securing apertures 88 of the spacer 80, thereby securing the spacer 80 to the blade cartridge 10. The forward portion of the spacer 80 includes a plurality of passages 90. Preferably the passages 90 are recessed portions, as depicted in the figures, although other structures may be used such as channels.

Similar to the first blade 60, the second blade 100 includes securing apertures 108 which align with the securing apertures 40 of the blade seat 22 so as to allow the staking pins 122 to pass through the securing apertures 108 of the second blade 100, thereby securing the blade to the blade cartridge 10. The second blade 100 is fixed between the upper surface 86 of the spacer 80 and lower surface 124 of the cap member 120. The second blade 100 includes a lower surface 104 and an upper surface 106. As depicted in FIGS. 7 and 8, an opening 46 is formed between the lower surface 104 of the second blade 100 and the upper surface 66 of the first blade 60. The opening 46 and passages 90 define a flow path that allows debris to flow through the apertures 70 in the first blade 60 and exit the bottom of the blade cartridge 10. The opening 46 and passages 90 also allow the shaver to direct water through the bottom of the blade cartridge 10 and flush water and debris through the apertures 70 in the first blade 70 and out the opening 46.

The blades 60 and 100 of the present invention are positioned within the blade cartridge 10 beginning with the lower surface 64 of the first blade 60 being disposed on the upper surface 38 of the blade seat 22. The lower surface 84 of the spacer 80 is disposed on the upper surface 66 of the first blade 60. The lower surface 104 of the second blade 100 is disposed on the upper surface 86 of the spacer 80. The spacer 80 exhibits a uniform height so that when the blades 60 and 100 are secured to the upper surface 86 and lower surface 84 of the spacer 80, respectively, such that the blades 60 and 100 are parallel to one another. The lower surface 124 of the cap member 120 is disposed on the upper surface 106 of the second blade 100. FIGS. 7 and 8 illustrate the alignment of the first blade 60, the spacer 80, and the second blade 100. As depicted the cutting edge 62 of the first blade 60 is located forward of the cutting edge 102 of the second blade 100.

The cap member 120 includes an upper surface 128 that acts as a skin engaging surface as the blade cartridge 10 is passed over the skin of a shaver. The cap member 120 includes a plurality of staking pins 122, such as rivets. The staking pins 122 extend downwardly from the lower surface 124 of the cap member 120 and pass through the securing apertures 108 of the second blade 100, through the securing apertures 88 of the spacer 80, through the securing apertures 68 of the first blade 60, and into the securing apertures 40 of the blade seat 22. The ends of the staking pins 122 extend beyond the blade seat 22 and are upset (the staking pins 122 are depicted prior to upsetting the end thereof) thereby permanently affixing the blade seat 22, blades 60 and 100, spacer 80, and cap member 120 together. As a result of mounting the blades 60 and 100 in accordance with the present invention, there is no longitudinal movement of any of the blades 60 and 100 relative to the remainder of the blade cartridge 10.

Numerous variations of the blades 60 and 100 are possible. For example, each blade 60 and 100 may be tapered such that the thickness of the blade decreases in the direction of the forward portion of the blade. Also, each blade 60 and 100 can comprise a U-shaped channel in the forward portion of the blades. Finally, additional holes can be added to the blades of the preferred embodiment.

In yet another variation, a shaving aid or lubrication applicator 130 may be affixed or included with the blade cartridge 10. Typically the shaving aid 130 comprises a polystyrene-polyethylene oxide blend in the form of lubricating strip 132, which may affixed to the upper surface 126 of the cap member 120 behind the second blade 100. During shaving, the polyethylene oxide bleaches out of the styrene matrix. The cap member 120 may have a lube strip 132 glued onto or molded onto the cap member 120 in a second shot. Preferably, the shaving aid 130 comprises a matrix of polystyrene, polyethylene oxide and aloe and/or vitamin E and/or other additives.

In yet a further variation, the blade cartridge 10 may be permanently or detachably connected to a handle by suitable structures formed on the bottom surface of the blade cartridge 10. For example, as illustrated in FIGS. 7 and 8, the bottom surface of the platform member 20 includes a mounting device 50 that allows the blade cartridge 10 to be detachably mounted to a handle. The mounting device 50 includes a pair of mounting hooks 52 that form a slot 54 for mounting to a handle. Alternatively, the blade cartridge 10 may be integrally attached to a handle in the form of a disposable razor.

A novel feature of the present invention is the one or more protruding members 140, 142, and 144, or guard ribs, positioned proximate the skin engaging edges of the blades such that a portion of the blade adjacent the guard ribs has a negative exposure. The guard member 30 of the platform member 20 includes a plurality of guard ribs 140 evenly spaced along the length of the blade cartridge 10. Preferably, the guard ribs 140 each have an arcuate contact surface 141 and are narrow in thickness in a direction along the skin engaging edge 62 of the first blade 60. Alternatively, however, the contact surface 141 may be configured to be planar or wide or have a varying width. The guard ribs 140 are positioned proximate the skin engaging edge 62 of the first blade 60 such that a portion of the first blade adjacent the guard ribs 140 has a negative exposure based on the shaving plane 2 depicted in FIG. 8. The portions of the first blade 60 in between the guard ribs 140 are allowed to fully engage the skin of the shaver while the guard ribs 140 prevent overexposure of the skin to the cutting edge 62.

In addition to the guard ribs 140 on the platform member 20, the present invention further includes protruding members 142, or guard ribs, on the spacer 80 and protruding members 144, or guard ribs, on the cap member 120. The guard ribs 142 on the spacer 80 are positioned proximate to the skin engaging edge 62 of the first blade 60 and the skin engaging edge 102 of the second blade 100. The guard ribs 144 on the cap member 120 are positioned proximate to the skin engaging edge 102 of the second blade 100. In the preferred embodiment the guard ribs 140 on the platform member 20, the guard ribs 142 on the spacer 80, and the guard ribs 144 on the cap member 120 are aligned such that they form evenly spaced rows along the length of the blade cartridge 10.

A second embodiment 12 of the present invention is depicted in FIG. 9. The second embodiment 12 is substantially identical to the first embodiment 10, except that in the second embodiment 12 the guard ribs 150 on the platform member 20, guard ribs 160 on the spacer 80, and guard ribs 170 on the cap member 120 are aligned with each other and are substantially continuous. The guard rib 150 has a wall 152 that abuts a wall 162 on the guard rib 160 such that contact surfaces 151 and 161, respectively, are flush and substantially continuous or continuous. Similarly, the guard rib 160 has a wall 164 that abuts a wall 172 on the guard rib 170 such that contact surfaces 161 and 171, respectively, are flush and substantially continuous or continuous.

A third embodiment 14 of the present invention is depicted in FIGS. 10–15. The third embodiment 14 is substantially identical to the first embodiment 10, except that the third embodiment 14 does not include a second blade or a spacer. Referring to FIGS. 10–15, the third embodiment 14 of the present invention includes a platform member 220, a primary blade 260, and a cap member 320. As depicted in FIGS. 14 and 15, the platform member 220 includes a blade seat 222 having a front wall 224 and a rear wall 226. The guard member 230 extends parallel to the front wall 224 forming a flow channel or slot 234 between the guard member 230 and the front wall 224. The guard member 230 is connected to the front wall 224 by a plurality of support members 236, which extend substantially perpendicular to the longitudinal axis of the both the guard member 230 and the front wall 224. The guard member 230 placed in front of the first blade 260 is integral with the platform member 220 and is therefore stationary relative to the blade cartridge 14. The guard 230 being positioned in front of the first blade 260 has a raised skin engaging portion 232, which provides an engaging surface to control exposure of the first blade 260 to the shaver's skin.

The support members 236 extend downwardly away from the upper surface 238 of the blade seat 222 so as to create a gap 242 between a lower surface 264 of the first blade 260 and the guard member 230. The gap 242 allows for the passage of water and shaving debris beneath the first blade 260, through the slot 234, and out the bottom of the blade cartridge 14.

The blade seat 222 includes an upper surface 238, as well as a plurality of securing apertures 240. The securing apertures 240 operate in conjunction with staking pins (or rivets) 322 located on the cap member 320 to permanently secure the platform member 220, the blade 260, and the cap member 320 together.

The first blade 260 is fixed between the upper surface 238 of the blade seat 222 and a lower surface 324 of the cap member 320. The first blade 260 has a lower surface 264 and an upper surface 266. The first blade 260 includes securing apertures 268 which align with the securing apertures 240 of the blade seat 222 so as to allow the staking pins 322 to pass through the securing apertures 268 of the first blade 260, thereby securing the first blade 260 to the blade cartridge 14. In the third embodiment the first blade 260 has a plurality of apertures 270 along the forward portion thereof that allow debris to travel through the apertures 270 and out the bottom of the blade cartridge 14.

The cap member 320 includes an upper surface 328 that acts as a skin engaging surface as the blade cartridge 14 is passed over the skin of a shaver. The cap member 320 includes a plurality of staking pins 322, such as rivets. The staking pins 322 extend downwardly from the lower surface 324 of the cap member 320 and pass through the securing apertures 268 of the first blade 260, and into the securing apertures 240 of the blade seat 222. The ends of the staking pins 322 extend beyond the blade seat 222 and are upset (the staking pins 322 are depicted prior to upsetting the end thereof) thereby permanently affixing the blade seat 222, blade 260, and cap member 320 together. As a result of mounting the blade 260 in accordance with the present invention, there is no longitudinal movement of the blade 260 relative to the remainder of the blade cartridge 14.

The forward portion of the cap member 320 includes a plurality of passages 327. Preferably the passages 327 are recessed portions, as depicted in the figures, although other structures may be used such as channels. The passages 327 define a flow path that allows debris to flow through the apertures 270 in the first blade 260 and exit the bottom of the blade cartridge 14. The passages 327 also allow the shaver to direct water through the bottom of the blade cartridge 14 and flush water and debris through the apertures 270 in the first blade 270.

The third embodiment 14 of FIGS. 11–15 may also include a shaving aid or lubrication applicator 330 in the form of lubricating strip 332 as described for the first embodiment 10. As in the first embodiment 10, the third embodiment may include a mounting device 250 that allow the blade cartridge 14 to be detachably mounted to a handle. The mounting device 250 includes a pair of mounting hooks 252 that form a slot 254 for mounting to a handle. Alternatively, the third embodiment 14 may be permanently or integrally mounted to a handle.

The third embodiment 14 also includes one or more protruding members 340 and 344, or guard ribs, positioned proximate the skin engaging edge of the blade such that a portion of the blade adjacent the guard ribs has a negative exposure. As in the first embodiment 10, the guard member 230 of the platform member 220 of the third embodiment 14 preferably includes a plurality of guard ribs 340 evenly spaced along the length of the blade cartridge 14. Preferably, the guard ribs 340 each have an arcuate contact surface 341 and are narrow in thickness in a direction along the skin engaging edge 262 of the first blade 260. The guard ribs 340 are positioned proximate the skin engaging edge 262 of the first blade 260 such that a portion of the first blade adjacent the guard ribs 340 has a negative exposure based on the shaving plane 4 depicted in FIG. 15. The portions of the first blade 260 in between the guard ribs 340 are allowed to fully engage the skin of the shaver while the guard ribs 340 prevent overexposure of the skin to the cutting edge 262.

In addition to the guard ribs 340 on the platform member 220, the present invention further includes protruding members 344, or guard ribs, on the cap member 320. The guard ribs 344 on the cap member 320 are positioned proximate to the skin engaging edge 262 of the first blade 260. In the preferred embodiment the guard ribs 340 on the platform member 220 and the guard ribs 344 on the cap member 320 are aligned such that they form evenly spaced rows along the length of the blade cartridge 14.

A fourth embodiment 16 of the present invention is depicted in FIG. 16. The fourth embodiment 16 is substantially identical to the second embodiment 12. In the fourth embodiment 16 the guard ribs 350 on the platform member 220, and guard ribs 370 on the cap member 320 are aligned with each other and are substantially continuous. The guard rib 350 has a wall 352 that abuts a wall 372 on the guard rib 370 such that contact surfaces 351 and 371, respectively, are flush and substantially continuous or continuous.

A fifth embodiment of the present invention is depicted in FIG. 17. The razor blade cartridge 400 is similar to the embodiment illustrated in FIGS. 1–8, except for the manner in which the guard ribs on the guard do not extend from the guard toward proximate the first, or primary, blade. Specifically, the razor blade cartridge 400 includes a plurality of first guard ribs 440 disposed on the platform member 20, a plurality of second guard ribs 442 disposed on the spacer (not shown), and a plurality of third guard ribs 444 disposed on the cap member 120. The first guard ribs 440 can be alternately aligned with either a second guard rib 442 and/or a third guard rib 444. An alternate of the fifth embodiment has the 1st of six first guard ribs 440 aligned with the 1st of six third guard ribs 444. The 2nd of the first guard ribs 440 is aligned with the 1st of the second guard ribs 442. The 3rd of the first guard ribs 440 is aligned with the 2nd of the third guard ribs 444. The 4th of the first guard ribs 440 is aligned with the 2nd of the second guard ribs 442, etc. This pattern would then continue to repeat itself across the razor blade cartridge. The number of first guard ribs 440 should be close to the sum of the number of second guard ribs 442 and third guard ribs 444.

A sixth embodiment of the present invention is depicted in FIG. 18. The razor blade cartridge 500 is substantially identical to the embodiment illustrated in FIG. 17, except for various differences to be described. The razor blade cartridge 500 includes a plurality of first guard ribs 540 disposed on the platform member 20, a plurality of second guard ribs 542 disposed on the spacer (not shown), and a plurality of third guard ribs 544 disposed on the cap member 120. The first guard ribs 542 are not aligned with the third guard ribs, and the second guard ribs 542 are not aligned with either a first guard rib 540 or a third guard rib 544.

FIG. 19 illustrates a seventh embodiment 600 of razor blade cartridge 600 in accordance with the present invention. The razor blade cartridge 600 is similar to the embodiment illustrated in FIG. 18, but contains various differences. The razor blade cartridge 600 includes a plurality of first guard ribs 640 disposed on the platform member 20, a plurality of second guard ribs 642 disposed on the spacer (not shown), and a plurality of third guard ribs 644 disposed on the cap member 120. The second guard ribs 642 are alternately aligned with either a first guard rib 640 or a third guard rib 644. As illustrated in FIG. 19, the guard ribs 640, 642, 644 are disposed such that none of the first, second, or third guard ribs 640, 642, 644 are all in alignment with each other. In a preferred embodiment, one of the second guard ribs 642 is disposed between each pair of third guard ribs 644, and in turn is disposed to be aligned with a first guard rib 642. As further illustrated in FIG. 19, there is a larger number of second guard ribs 642 than of the first or third guard ribs, 642, 644, which are formed having a flared "bear claw" appearance with a single guard rib protrusion 642. The spacer 80 includes on the rear portion of each rib 642 concave flare portions 681, 682 (or other curved surface flare portions) in either or both the vertical and/or horizontal directions. The first blade 650 does not contain any flow debris apertures (such as those numeral 70 in FIG. 1) and in lieu thereof, the above flare portions 681, 682 assist the shaver by redirecting any shaving debris away for protrusions 642.

FIG. 20 illustrates an eighth embodiment of a razor blade cartridge 700 in accordance with the present invention. The razor blade cartridge 700 is similar to the embodiment illustrated in FIG. 18, but contains various differences. The razor blade cartridge 700 includes a plurality of first guard ribs 740 disposed on the platform member 20, a plurality of second guard ribs 742 disposed on the spacer (not shown), and a plurality of third guard ribs 744 disposed on the cap member 120. As illustrated in FIG. 20, the guard ribs 740, 742, 744 are disposed such that none of the first, second, or third guard ribs 740, 742, 744 are all in lateral alignment with each other. The first, second and third guard ribs 740, 742, 744 are laterally positioned such that pair of second guard ribs 742 is framed on each side of a first guard rib 740. The pair of guard ribs 742 is in turn laterally framed by pair of third guard ribs 744. As illustrated a "V" or "W" pattern may be formed. Alternately, other geometric or random patterns may formed by the first, second and third guard ribs.

As further illustrated in FIG. 20, the second guard ribs 742 are formed contiguous with each other and having concave recesses 781 positioned between each guard rib. Furthermore, the second blade 750 does not contain any apertures.

As described in FIGS. 17–20, the placement of the first, second and third guard ribs can take a number of configurations, which in turn defines a shaving plane and subsequent blade exposure at the tip of each guard rib. By having such guard rib configurations, it can readily be understood the guard ribs will assist the shaver to maintain correct blade exposure and shaving angle over various curves and shapes on the skin surface as they are encountered by the shaver. Such skin engaging points not only define the shaving plane at the tip of the guard ribs, but they also assist the shaver in maintaining the proper blade exposure and shaving angle.

Figure 21:
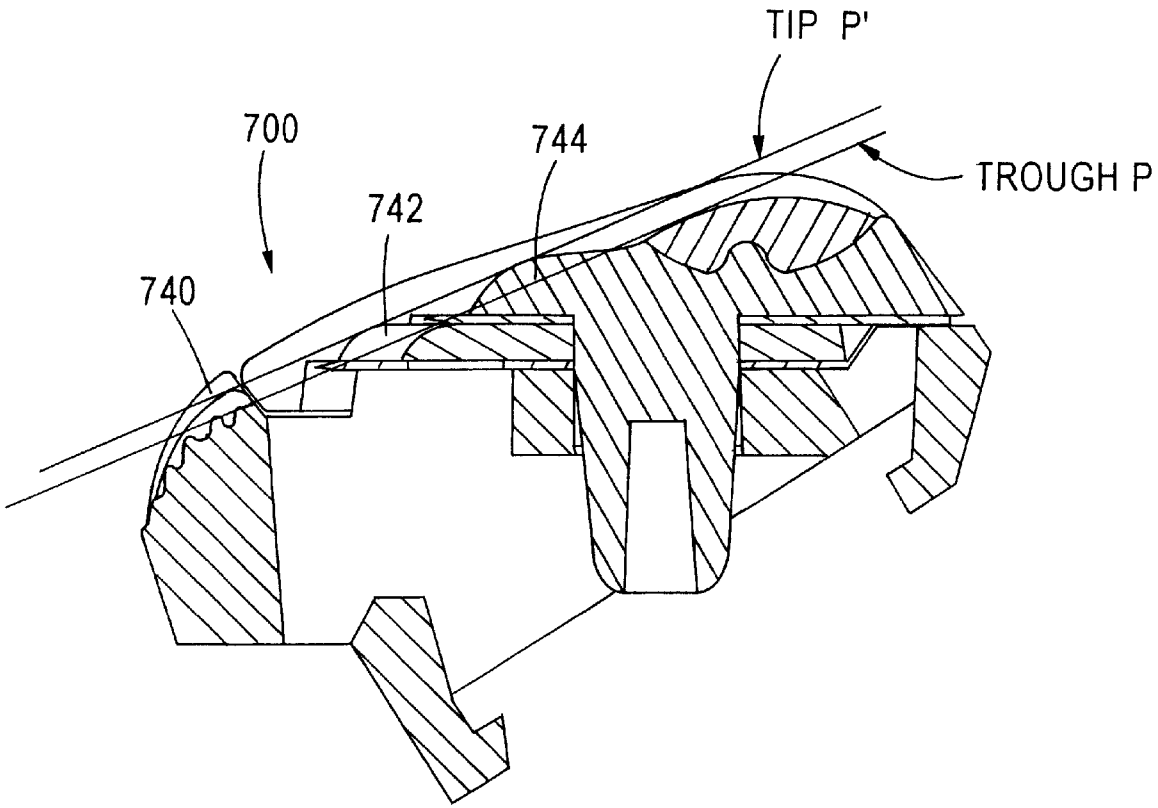
FIG. 21 is a cross section view of the razor blade cartridge taken along a cap guard rib 744 of FIG. 20.

Merely by way of example, the above embodiments of the inventive razor cartridge (or "Virtual Guard Razor") has a series of "guard" projections on the guard (or guard bar), spacer, and cap (or top cover), as illustrated in the above drawings. Further, each of the embodiments of the Virtual Guard includes two modifications depending upon "blade exposure" for the "trough" exposure away from the projections (shown as "P", and tip "exposure" on the projections (shown as "P'"). The first modification is termed a "003" Virtual Guard structure and the second is termed a "006" Virtual Guard structure. FIG. 21 illustrates a cross section FIG. 20 along the rib 744 that shows the "tip" and "trough" blade exposure. As illustrated in the below schematic illustration, each of the above versions of Virtual Guard razors may have either a "0.003" or "0.006" tip or trough "blade exposure," as illustrated. The blade exposure for a shaving plane positioned at a trough (or below the ribs) has the following positive blade exposure for each of the above modifications.

| Trough P | Blade Exposure |
|---|---|
| .003 | about + 1.270 mm |
| .006 | about + 0.508 mm |

The blade exposure for a shaving plane at the tip (or at the top of the ribs) has the following negative exposure.

| Tip P' | Blade Exposure |
|---|---|
| .003 | about − 0.762 mm |
| .006 | about − 1.500 mm |

Other modifications of combinations of blade exposure, such as zero ("0.00") blade exposure in combination with positive and negative blade exposure are possible. Further, the blade exposure for a blade may vary between two points of skin engaging surfaces, such that a single cartridge may have different primary and secondary blade exposures.

Only the preferred embodiment of the invention and an example of its versatility are shown and described in the present disclosure. It is to be understood that the invention is capable of use in various other combinations and environments and is capable of changes or modifications within the scope of the inventive concept as expressed herein. Of course, it should be understood that a wide range of changes and modifications could be made to the preferred embodiments described above. It is therefore intended that the present invention is not limited to the embodiments described above, but encompasses any and all embodiments within the scope of the following claims, and equivalents thereof.

What is claimed is:

1. A razor blade cartridge comprising:

a platform member having a blade seat and a guard member; said guard member having a plurality of first guard ribs;

a first blade disposed on said blade seat, said first blade having a skin engaging edge located rearwardly of said guard member;

a spacer disposed on said first blade;

a second blade disposed on said spacer, said second blade having a skin engaging edge located rearwardly of said skin engaging edge of said first blade;

a cap member disposed on said second blade, said cap having a plurality of third guard ribs;

said spacer including a plurality of second guard ribs positioned proximate said skin engaging edge of said first blade and said skin engaging edge of said second blade such that a portion of said first blade and said second blade adjacent to any of the plurality of second guard ribs of said spacer has a negative exposure from between about −0.762 mm to −1.5 mm.

2. The razor blade cartridge of claim 1, wherein the number of said plurality of first guard ribs is approximately equal to the sum of the number of said plurality of second guard ribs plus the number of said plurality of third guard ribs, and wherein each of said plurality of first guard ribs is alternately aligned with either one of said plurality of second guard ribs or one of said plurality of third guard ribs.

3. A razor blade cartridge comprising:

a platform member having a blade seat, a guard member and a protruding member;

a first blade disposed on said blade seat, said first blade having a skin engaging edge located rearwardly of said guard member;

a spacer disposed on said first blade; said spacer having guard ribs positioned thereon;

a second blade disposed on said spacer, said second blade having a skin engaging edge located rearwardly of said skin engaging edge of said first blade;

a cap member disposed on said second blade, said guard member having guard ribs positioned proximate to and along the full lateral distance of said guard member such that a portion of said first blade adjacent said protruding member of said platform member has a negative blade exposure from between about −0.762 mm to about −1.5 mm.

4. A razor blade cartridge comprising:

a platform having a blade seat having at least one blade disposed on said blade seat, said blade having a skin engaging edge; said platform having a guard in front of said blade edge and a cap disposed on said platform rearwardly of said blade edge, said guard and said cap defining skin engaging surfaces and each including a plurality of guard ribs projecting above said guard and said cap to define blade exposure at a shaving plane at a tip of said guard ribs from between about −0.762 mm to −1.5 mm, and a blade exposure at a shaving plane at a trough from between about +0.508 mm to about +1.270 mm.

5. The razor blade cartridge according to claim 4 wherein said platform includes a protruding member positioned proximate said skin engaging edge such that a portion of said blade adjacent said protruding member has a negative exposure.

6. The razor blade cartridge according to claim 5 wherein said protruding member on said platform is aligned with a protruding member on said cap.

7. The razor blade cartridge according to claim 6 wherein said protruding member on said platform member is substantially continuous with said protruding member on said cap.

8. The razor blade cartridge according to claim 5 wherein said protruding member has an arcuate contact surface and is narrow in thickness in a direction along said skin engaging edge.

9. The razor blade cartridge according to claim 4 wherein said cap includes a plurality of protruding members protruding positioned proximate said skin engaging edge such that a portion of said blade adjacent each protruding member of said plurality of protruding members has a negative exposure.

10. The razor blade cartridge according to claim 4 wherein said blade has an aperture for allowing lubricant to flow therethrough.

11. The razor blade cartridge according to claim 10 wherein said cap has an open portion abutting said aperture on said blade for allowing lubricant to flow therethrough.

12. The razor blade cartridge according to claim 4 wherein said platform includes a guard member disposed forward of said blade seat so as to form a slot between said blade seat and said guard member.

13. A razor blade cartridge comprising:

a platform member having a blade seat and a guard member;

a first blade disposed on said blade seat, said first blade having a skin engaging edge located rearwardly of said guard member;

a spacer disposed on said first blade;

a second blade disposed on said spacer, said second blade having a skin engaging edge located rearwardly of said skin engaging edge of said first blade;

a cap member disposed on said second blade, said guard member, said spacer and said cap member each having a plurality of guard ribs positioned thereon, said guard ribs defining a blade exposure at a shaving plane at a tip of said guard ribs from between about −0.762 mm to about −1.5 mm, and a blade exposure at a shaving plane at a trough from between about +0.508 mm to about +1.270 mm.

14. The razor blade cartridge according to claim 13 wherein said guard ribs are formed in a pattern such that one of the guard ribs of said guard member, said spacer or said cap member are laterally aligned with one of the other guard ribs, and the remaining guard ribs are in a position in other than lateral alignment with the other guard ribs.

15. The razor blade cartridge of claim 13 wherein said first blade has an aperture for allowing lubricant to flow therethrough.

16. The razor blade cartridge of claim 15 wherein said spacer has an open portion abutting skid aperture on said first blade for allowing lubricant to flow therethrough.

17. The razor blade cartridge of claim 13 wherein said spacer guard ribs have curved surfaces on each side of said guard rib that form a rear portion of said guard rib which is of a greater width than the width of the front part of said guard ribs.

18. The razor blade cartridge of claim 13 wherein said spacer guard ribs have a concave surface positioned between each guard rib.

19. The razor blade cartridge of claim 13 wherein the number of said guard ribs on the spacer is greater than the number of said guard ribs on the guard member.

20. The razor blade cartridge of claim 13 wherein the number of said guard ribs on the spacer is greater than the number of said guard ribs on the cap member.

21. The razor blade cartridge of claim 13, wherein the cap member includes a shaving aid.

22. The razor blade cartridge of claim 13, in combination with a razor handle connectable to said cartridge.

23. The razor blade cartridge of claim 13, including a razor handle affixed to said cartridge.

24. The razor blade cartridge of claim 13, wherein said guard ribs extend along the lateral portion of said guard member, said guard ribs truncated at the rear of said guard member to define a shaving debris space between said guard ribs and said first blade edge.

* * * * *